US010167589B2

(12) United States Patent
Kim et al.

(10) Patent No.: US 10,167,589 B2
(45) Date of Patent: Jan. 1, 2019

(54) METHOD FOR CONTROLLING RINSING CYCLE OF WASHING MACHINE

(71) Applicant: LG ELECTRONICS INC., Seoul (KR)

(72) Inventors: Naeun Kim, Seoul (KR); Hwanjin Jung, Seoul (KR); Sanghyun Lee, Seoul (KR); Bonkwon Koo, Seoul (KR); Sunho Lee, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/283,763

(22) Filed: Oct. 3, 2016

(65) Prior Publication Data

US 2017/0096764 A1 Apr. 6, 2017

(30) Foreign Application Priority Data

Oct. 2, 2015 (KR) ..... 10-2015-0139272
Oct. 2, 2015 (KR) ..... 10-2015-0139277
(Continued)

(51) Int. Cl.
*D06F 37/36* (2006.01)
*D06F 35/00* (2006.01)
(Continued)

(52) U.S. Cl.
CPC ..... *D06F 37/36* (2013.01); *D06F 33/02* (2013.01); *D06F 35/006* (2013.01); *D06F 37/12* (2013.01);
(Continued)

(58) Field of Classification Search
None
See application file for complete search history.

(56) References Cited

U.S. PATENT DOCUMENTS 3,324,688 A 6/1967 Hubbard, Jr.
5,031,427 A 7/1991 Pastryk et al.
(Continued)

FOREIGN PATENT DOCUMENTS

EP 0 464 776 1/1992
EP 2 698 464 2/2014
(Continued)

OTHER PUBLICATIONS

Abstract of WO 2013035279 A1 (Year: 2013).*
(Continued)

*Primary Examiner* — Michael E Barr
*Assistant Examiner* — Cristi J Tate-Sims
(74) *Attorney, Agent, or Firm* — Ked & Associates, LLP

(57) ABSTRACT

A method for controlling a rinsing cycle of a washing machine is provided. The method may include a primary rinsing by supplying water into the inner tub until a water level in the outer tub becomes a preset circulating water level, wherein some of the water is supplied through a drawer in the washing machine that holds fabric softener, and a remaining amount of water is supplied by spraying the water supplied from the external water source through the direct water nozzle via a direct water supply hose, a secondary rinsing by spraying water into the inner tub through the circulating nozzle, and a third rinsing by spraying the water into the inner tub through the direct water nozzle while draining the outer tub.

12 Claims, 39 Drawing Sheets

(30) Foreign Application Priority Data

Oct. 2, 2015 (KR) ..... 10-2015-0139279
Oct. 8, 2015 (KR) ..... 10-2015-0141714

(51) Int. Cl.

| | |
|---|---|
| ***D06F 37/12*** | (2006.01) |
| ***D06F 39/08*** | (2006.01) |
| ***D06F 37/30*** | (2006.01) |
| ***D06F 33/02*** | (2006.01) |
| *D06F 23/04* | (2006.01) |

(52) U.S. Cl.

CPC ..... *D06F 37/304* (2013.01); *D06F 39/085* (2013.01); *D06F 39/088* (2013.01); *D06F 23/04* (2013.01); *D06F 2202/10* (2013.01); *D06F 2204/06* (2013.01); *D06F 2204/08* (2013.01); *D06F 2204/10* (2013.01)

(56) References Cited

U.S. PATENT DOCUMENTS

| | | | | |
|---|---|---|---|---|
| 5,167,722 | A * | 12/1992 | Pastryk | D06F 35/006 134/33 |
| 5,271,251 | A * | 12/1993 | Kovich | D06F 35/006 68/171 |
| 5,582,039 | A * | 12/1996 | Mueller | D06F 37/12 68/17 R |
| 6,842,929 | B2 | 1/2005 | Kim et al. | |
| 2003/0051514 | A1 | 3/2003 | Kim et al. | |
| 2004/0163427 | A1 | 8/2004 | Oh et al. | |
| 2005/0125909 | A1 | 6/2005 | Bellinetto et al. | |
| 2008/0229517 | A1* | 9/2008 | Amarillas | D06F 35/005 8/159 |
| 2009/0229312 | A1 | 9/2009 | Chung et al. | |
| 2009/0241270 | A1 | 10/2009 | La Belle et al. | |
| 2010/0236001 | A1* | 9/2010 | Lee | D06F 33/02 8/159 |
| 2010/0281927 | A1 | 11/2010 | Lee et al. | |
| 2011/0000558 | A1 | 1/2011 | Harwood et al. | |
| 2011/0247148 | A1 | 10/2011 | Chanda et al. | |
| 2011/0265525 | A1 | 11/2011 | Gweon | |
| 2012/0114473 | A1 | 5/2012 | Badafem et al. | |
| 2012/0167931 | A1 | 7/2012 | Park et al. | |
| 2013/0091635 | A1 | 4/2013 | Guzman | |
| 2014/0033449 | A1* | 2/2014 | Im | D06F 39/08 8/137 |
| 2014/0096327 | A1 | 4/2014 | Lee et al. | |
| 2014/0259448 | A1* | 9/2014 | Alexander | D06F 33/02 8/137 |
| 2015/0211171 | A1 | 7/2015 | Favaro et al. | |
| 2015/0240405 | A1 | 8/2015 | Kwon et al. | |

FOREIGN PATENT DOCUMENTS

| | | |
|---|---|---|
| EP | 2 698 467 | 2/2014 |
| EP | 2 719 812 | 4/2014 |
| EP | 2 806 062 | 11/2014 |
| EP | 2 845 941 | 3/2015 |
| GB | 1 200 197 | 7/1970 |
| JP | S 56-098176 | 8/1981 |
| JP | S 62-066895 | 3/1987 |
| JP | H 05-068488 | 9/1993 |
| JP | H 08-173683 | 7/1996 |
| JP | H 09-192383 | 7/1997 |
| JP | H 11-019391 | 1/1999 |
| JP | H 11-276791 | 10/1999 |
| JP | 2000-189693 | 7/2000 |
| JP | 2001-070694 | 3/2001 |
| JP | 2001-300179 | 10/2001 |
| JP | 3434785 | 8/2003 |
| JP | 2004-065638 | 3/2004 |
| JP | 2004-116425 | 4/2004 |
| JP | 2007-029205 | 2/2007 |
| JP | 2007-282934 | 11/2007 |
| JP | 2008-012140 | 1/2008 |
| JP | 2008-073128 | 4/2008 |
| JP | 2009-297139 | 12/2009 |
| JP | 2010-046121 | 3/2010 |
| JP | 2010-046125 | 3/2010 |
| JP | 2012-157417 | 8/2012 |
| JP | 2013-188287 | 9/2013 |
| JP | 2014-054277 | 3/2014 |
| JP | 2014-100428 | 6/2014 |
| KR | 10-2000-0027871 | 5/2000 |
| KR | 10-2001-0018294 | 3/2001 |
| KR | 10-2001-0018300 | 3/2001 |
| KR | 10-2005-0012524 | 2/2005 |
| KR | 10-2009-0100155 | 9/2009 |
| KR | 10-2009-0122804 | 12/2009 |
| KR | 10-2010-0105339 | 9/2010 |
| KR | 10-2010-0110676 | 10/2010 |
| KR | 10-2010-0110717 | 10/2010 |
| KR | 10-2011-0009918 | 1/2011 |
| KR | 10-2011-0009926 | 1/2011 |
| KR | 10-2012-0011940 | 1/2011 |
| KR | 10-2011-0086421 | 7/2011 |
| KR | 10-2012-0012216 | 2/2012 |
| KR | 10-2012-0040793 | 4/2012 |
| KR | 10-2013-0109354 | 10/2013 |
| KR | 10-2014-0030187 | 3/2014 |
| KR | 10-2015-0099114 | 8/2015 |
| RU | 2 495 174 | 10/2013 |
| WO | WO 2009/102106 | 8/2009 |
| WO | WO 2013/035279 | 3/2013 |

OTHER PUBLICATIONS

Korean Office Action dated Jul. 1, 2016 issued in Application No. 10-2015-0139276.
Korean Office Action dated Aug. 2, 2016 issued in Application No. 10-2015-0139277.
Australian Office Action dated Aug. 2, 2017 issued in Application No. 2016234988.
Korean Office Action dated Jul. 13, 2016 issued in Application No. 10-2015-0141714.
Korean Office Action dated Aug. 18, 2016 issued in Application No. 10-2015-0139272.
Korean Office Action dated Feb. 28, 2017 issued in Application No. 10-2015-0139279.
Korean Notice of Allowance dated Dec. 5, 2016 issued in Application No. 10-2015-0139275.
Russian Search Report dated Sep. 6, 2017 issued in Application No. 2016138670/12(061603).
Korean Office Action dated Sep. 26, 2017 issued in Application No. 10-2015-0139279.
Russian Office Action (with full English translation) dated Oct. 17, 2017 issued in Application No. 2016138669/12(061602).
Australian Office Action dated Nov. 10, 2017 issued in Application No. 2016234984.
Russian Notice of Allowance dated Nov. 23, 2017 issued in Application No. 2016138672/12(061605).
Australian Office Action dated Dec. 5, 2017 issued in Application No. 2016234990.
Japanese Office Action dated Dec. 19, 2017 issued in Application No. 2016-195750.
Japanese Office Action dated Jan. 9, 2018 issued in Application No. 2016-195649.
Japanese Office Action dated Jan. 9, 2018 issued in Application No. 2016-195781.
United States Office Action dated Apr. 13, 2018 issued in co-pending related U.S. Appl. No. 15/283,488.
United States Office Action dated May 3, 2018 issued in co-pending related U.S. Appl. No. 15/283,662.

* cited by examiner

METHOD FOR CONTROLLING RINSING CYCLE OF WASHING MACHINE

CROSS-REFERENCE TO RELATED APPLICATION

This application claims priority under 35 U.S.C. § 119 to Korean Application Nos. 10-2015-0139279, filed on Oct. 2, 2015, 10-2015-0139272, filed on Oct. 2, 2015, 10-2015-0139277, filed on Oct. 2, 2015, and 10-2015-0141714, filed on Oct. 8, 2015, whose entire disclosures are incorporated herein by reference.

BACKGROUND

1. Field

Embodiments relate to a method for controlling a rinsing cycle of a washing machine.

2. Background

A washing machine is a device configured to process laundry through various operations, such as, e.g., laundry, dehydrating, and/or drying. The washing machine includes an outer tub configured to receive water and an inner tub rotatably provided in the outer tub. A through hole is formed through the inner tub so that water passes through the through hole. In a state that laundry, such as clothes or bedding, is provided into the inner tub, if a user selects a desired course using a control panel, the washing machine performs water supply and drainage, washing, rinsing, and dehydration by running a preset algorithm corresponding to the selected course.

An operation of a washing machine may be classified into difference cycles, such as, e.g., a washing cycle, a rinsing cycle, and a dehydration cycle. A progressing procedure of the cycles may be confirmed through a display included in a control panel. The washing cycle removes contaminations attached to fabrics or laundry by rotation of a pulsator and/or an inner tub and/or by supplying detergent into the inner tub together with water. The rinsing cycle rinses fabrics or laundry by supplying water in which the detergent is not dissolved into the inner tub. For example, the detergent absorbed in the fabric during the washing cycle is removed. During the rinsing cycle, a fabric softener may be supplied with the water. The dehydration cycle dehydrates fabrics by rotating an inner tub at high speed after the rinsing cycle is terminated. When the dehydration cycle is terminated, the whole operation of the washing machine may be terminated. In a case of a washing machine having a drying function, a drying cycle is added after the dehydration cycle.

The washing machine may be divided into a top load type, where fabrics are supplied from thea top side and an inner tub is rotated based on a vertical axis, and a front load type, where fabrics are supplied from a front and an inner tub is rotated based on a horizontal axis. A rinsing cycle generally performed in a top load type washing machine may be a deep rinsing type which rotates a pulsator included in the inner tub after supplying water to a water level sufficient for sinking fabrics supplied into the inner tub. Such a type has an excellent rinsing performance but increased an amount of water used.

A nozzle is included to reduce an amount of the water used while ensuring a sufficient rinsing performance. The nozzle sprays water supplied from a water source into an inner tub to improve a rinsing performance with a small amount of the water by making the sprayed water contact with fabrics. According to the related art, since drainage is performed simultaneously with spray of the water through the nozzle, the water sprayed through the nozzle penetrates the fabrics to be drained without change. Such a type may reduce the used amount of the water as compared with the deep rinsing type. However, the fabrics may not be soaked in the sprayed water so that a rinsing deviation occurs between the non-soaked part and remaining parts. In order to prevent the above problems, the spray may be performed from a sufficient time for sufficiently soaking all fabrics. However, since the amount of the water used is also increased proportional to the increased spray time, a separate gain cannot be obtained as compared with the deep rinsing type. Accordingly, there is a need for a method of ensuring a sufficient rinsing performance while reducing the amount of the water used.

BRIEF DESCRIPTION OF THE DRAWINGS

The embodiments will be described in detail with reference to the following drawings in which like reference numerals refer to like elements wherein.

DETAILED DESCRIPTION

Figure 1:
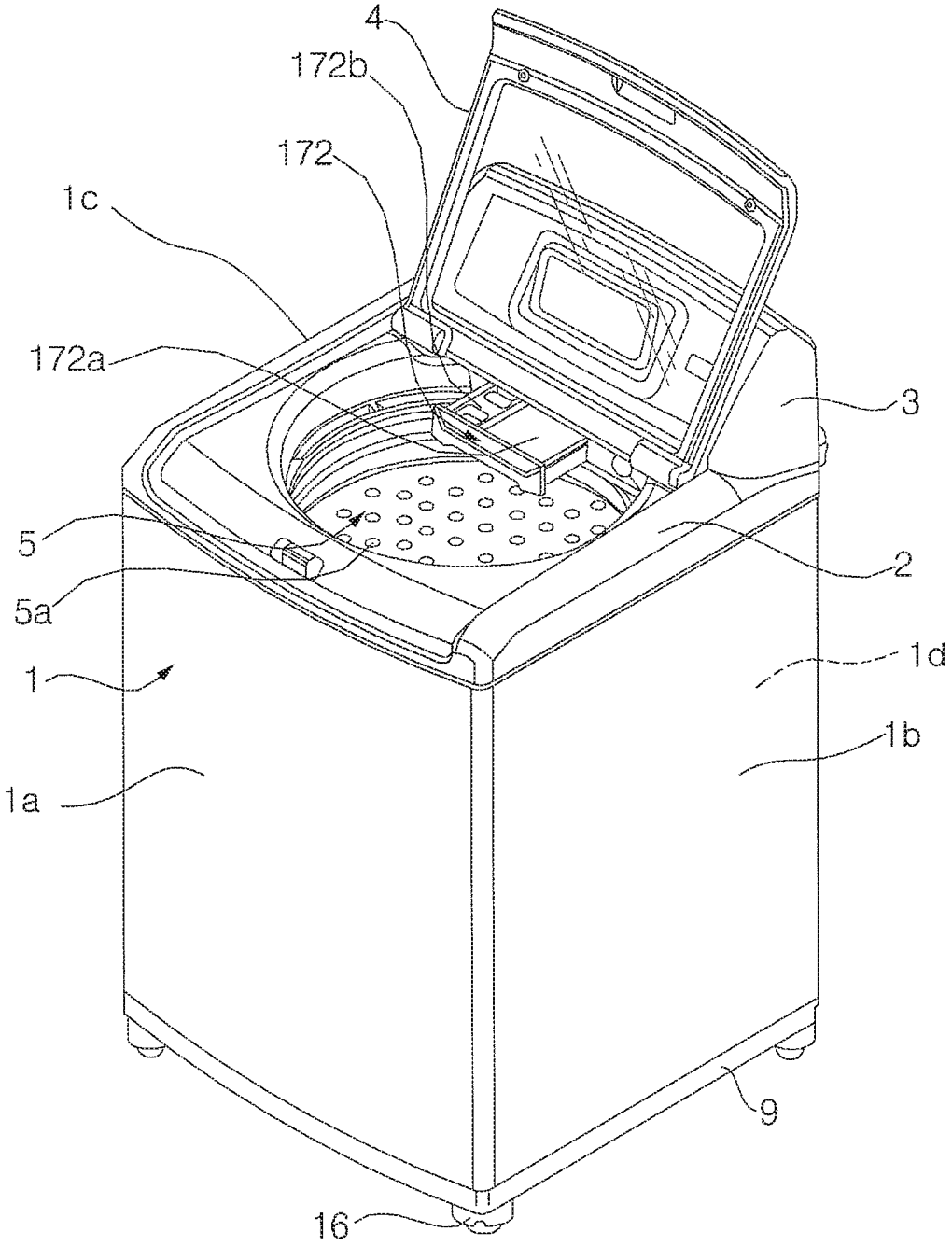
FIG. 1 is a perspective view illustrating a washing machine according to an embodiment.
Figure 2:
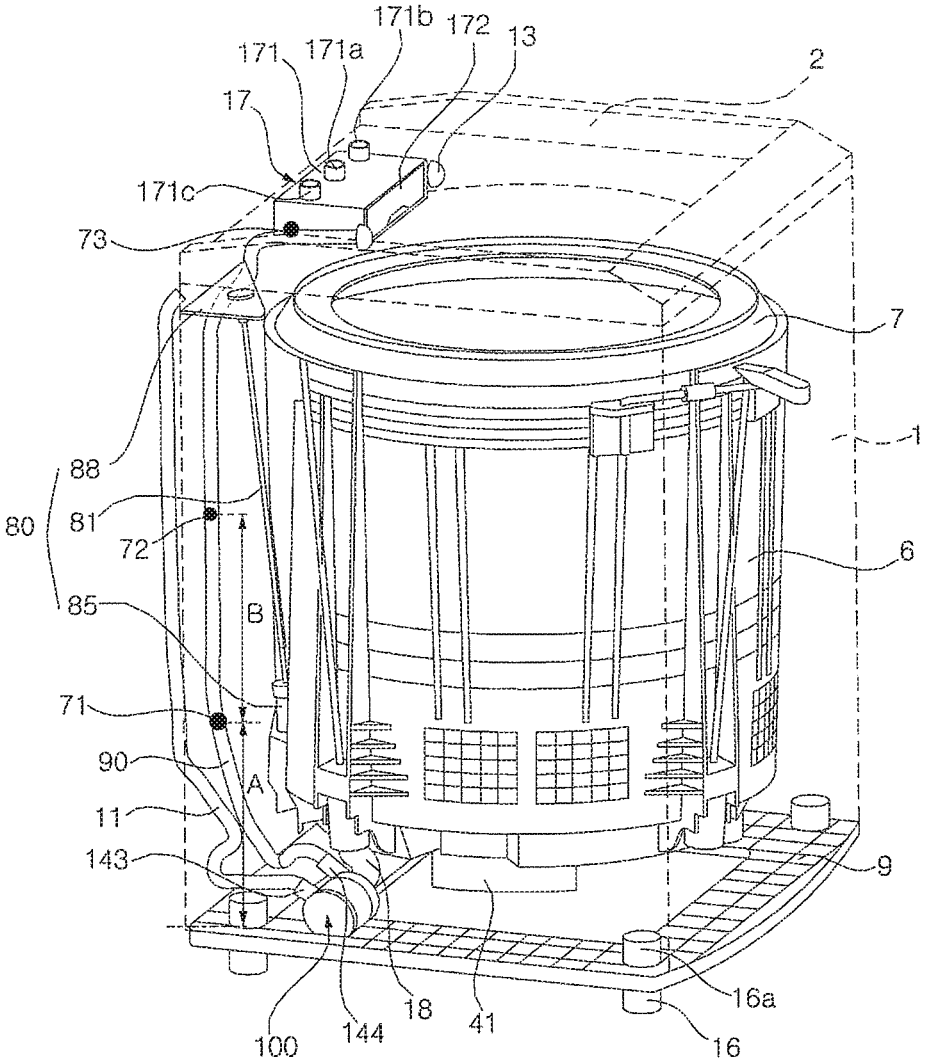
FIG. 2 is a side sectional view of the washing machine shown in FIG. 1.

Referring to FIG. 1 to FIG. 4, the washing machine according to an embodiment of the present disclosure may include a base 9, a cabinet 1, a top cover 2, a lid 4, and a control panel 3. The base 9 may have a flat shape corresponding to a bottom on which the washing machine is installed. The base 9 may be supported by four support bridges 16 which are provide close to four corners of a cabinet 1. The base 9 may be installed therein with a pump 100. The base 9 has a substantial square appearance. The support bridges 16 are installed spaced inward apart from four vertexes of the square. The support bridges 16 protrude to a lower side of the base 9 to make contact with a floor, for example, an indoor floor on which the washing machine is installed. The four support bridges 16 support the base 9, and the base 9 supports the whole parts of the washing machine.

The cabinet 1 is supported by the base 9. The cabinet 1 includes a front surface 1*a*, both lateral surfaces 1*b* and 1 *c*, and a rear surface 1*d*. A top surface and a bottom surface of the cabinet 1 may be opened. The top cover 2 may be coupled with a top end of the cabinet 1. An introduction hole for introducing and releasing laundry or fabric may be formed in the top cover 2. A lid 4 for opening/closing the introduction hole may be rotatably coupled with the top cover 2.

An outer tub 6 for receiving water may be provided in the cabinet 1. The outer tub 6 may be provided in the cabinet 1 by a hanger 8 in the hanged form. The hanger 8 may include a support rod 81 having a top end pivotably engaged with the top cover 2 and a suspension installed in the support rod 81 to buffer vibration of the outer tub 6. The suspension may be configured in various forms. For example, the suspension may include an outer tub support member which supports the outer tub 5 and is moved along the support rod 81 when the outer tub 6 vibrates.

Figure 3:
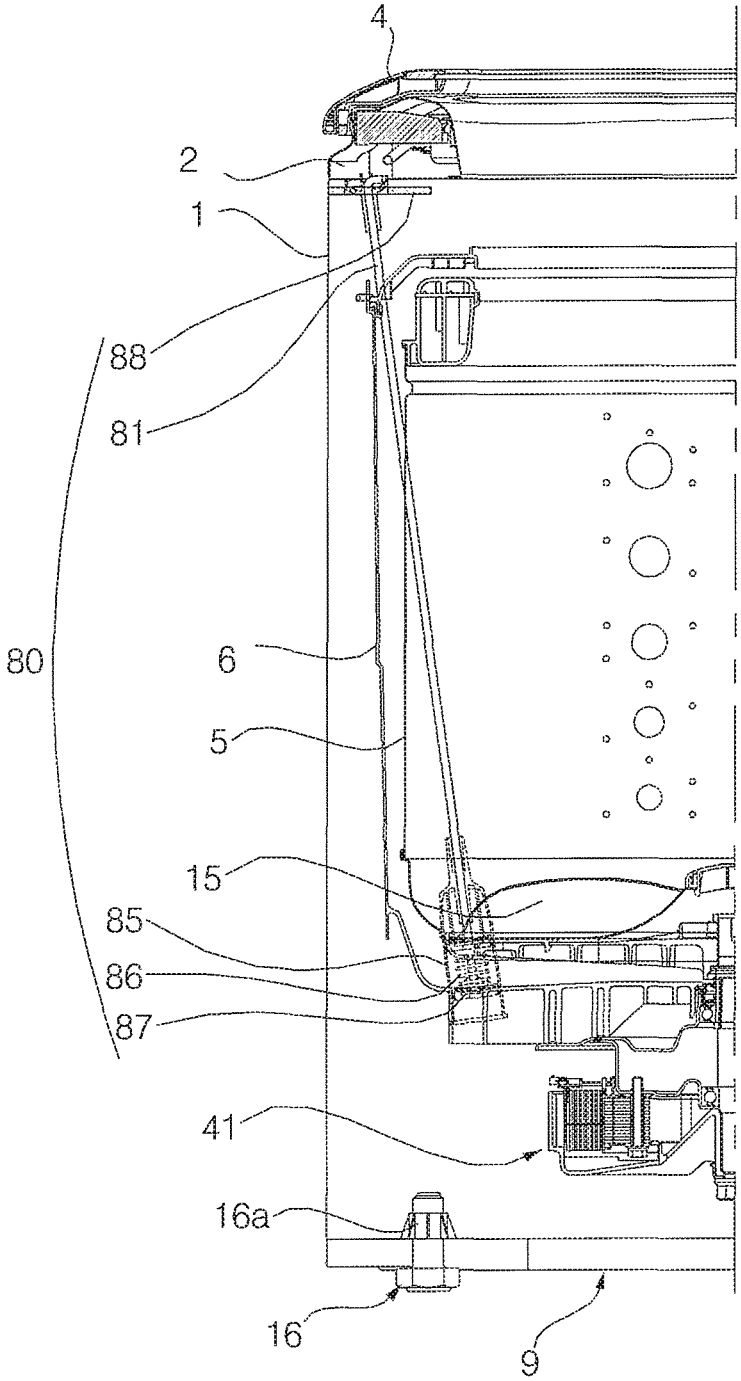
FIG. 3 is a sectional view illustrating a structure of a hanger of the washing machine shown in FIG. 1.
Figure 4:
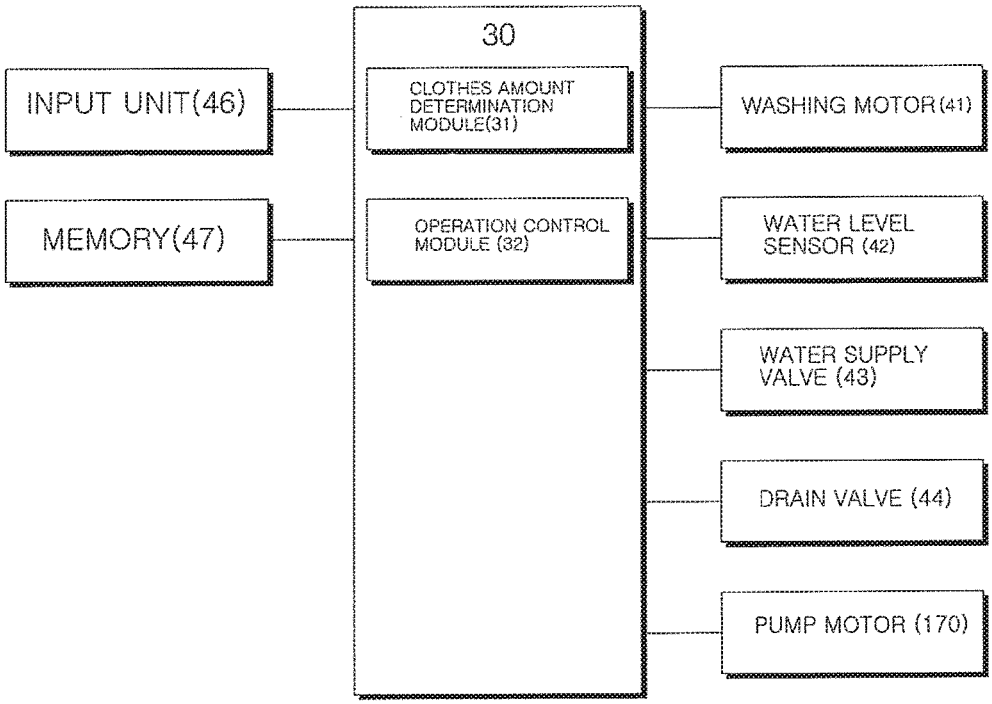
FIG. 4 is a block diagram illustrating a relationship between constituent elements of the washing machine shown in FIG. 1.
Figure 5A:
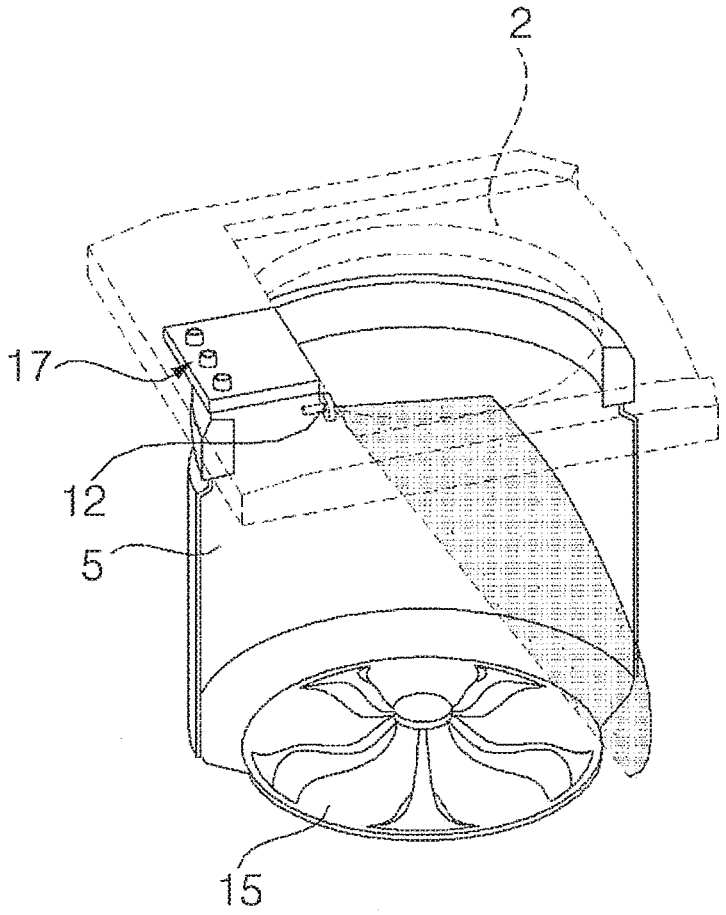
FIG. 5A illustrates a state in which water is sprayed through a circulating nozzle when an inner tub is under an unloaded condition.
Figure 5B:
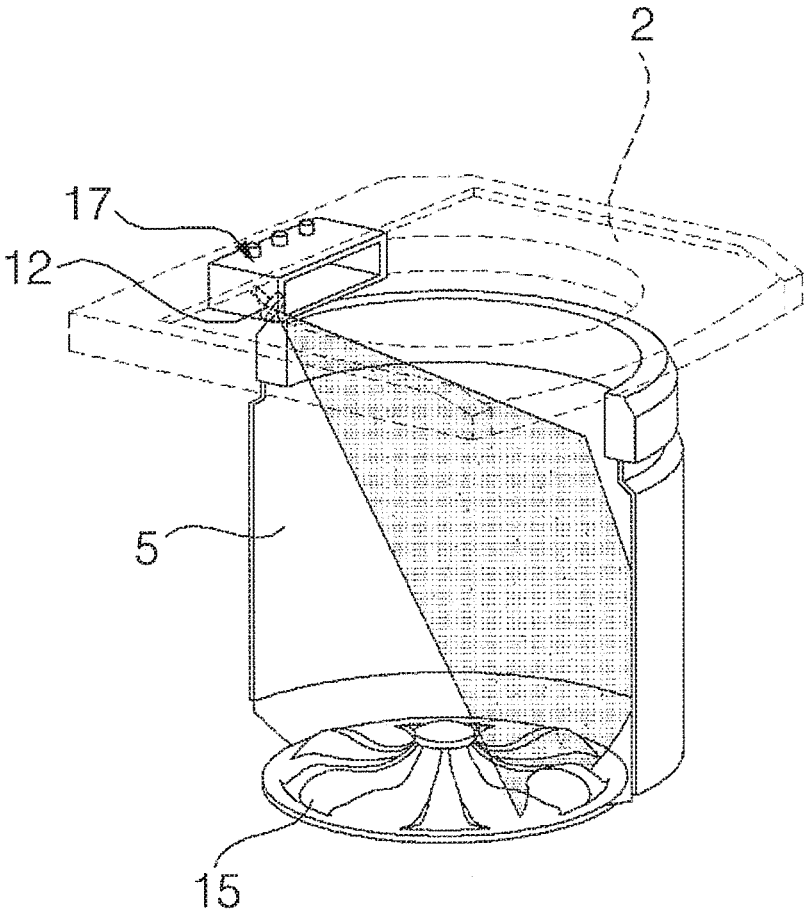
FIG. 5B illustrates a state in which water is sprayed through a circulating nozzle when an inner tub is under a maximum load condition.

Referring to FIG. 3, a hanger bracket 88 may be provided at a top side of the outer tub 6 in the cabinet 1. The hanger bracket 88 may be located at the top cover 2. A top end of the support rod 81 may be pivotably connected with the hanger bracket 88. The hanger 80 includes a support rod 81, a cap 85, and an elastic member 86. The cap 85 may be moved along the support rod 81 while being instead into the support rod 81. The outer tub 6 is supported by the cap 85 and is moved integrally with the cap 85 during a vibration procedure.

The support rod 81 may include a support rod base 82 formed at a bottom end thereof. The base 82 radially extends outward from a bottom end of the support rod 81. The elastic member 86 provided at an inner side of the cap 85 is located on a top surface of the support rod base 82. The elastic member 86 may be a spring. A top end of the spring supports the cap 85. Accordingly, while the cap 85 is displaced together with the outer tub 6, if the cap 85 is moved downward, the spring 86 is compressed. In contrast, if the cap 85 is moved upward, the spring 86 is recovered to an original state. Hanger brackets 88 may be provided around four corners of the cabinet 1 and/or the top cover 2. Four hangers 80 may be connected to the hanger brackets 88, respectively. When viewed from the top, the hangers 80 are installed around four corners of the cabinet 1, respectively.

A top side of the outer tub 6 is opened. An outer tub cover 7 may be provided at the open top side of the outer tub 6. A center portion of the outer tub cover 7 may have an open ring shape to introduce/release the laundry. An inner tub 5 for receiving laundry and being rotated based on a vertical axis may be provided in the outer tub 6. The inner tub 5 is formed therein with a plurality of holes through which water pass. The water may communicate between the inner tub 5 and the outer tub 6 through the hole 5*a*.

A drainage bellows 18 for exhausting water from the outer tub 6 and a drain valve 44 for blocking the drainage bellows 18 may be provided. The drainage bellows 18 is connected to a pump 100. When the drain valve 44 is opened under control of a controller 30, the water may be supplied into the pump 100 through the drainage bellows 18. Hereinafter, it should be understood that the pump 100 is operated in a state that the drainage bellows 18 is opened without separate description. A pulsator 15 may be rotatably installed at a lower inner side of the inner tub 5. The pulsator 15 may include a plurality of radial ribs which protrude upward. When the pulsator 15 is rotated, a water stream may be formed by the ribs.

A washing motor 41 for providing power to rotate the inner tub 5 and the pulsator 15 may be provided in the cabinet 1. The washing motor 41 is provided at a lower side of the outer tub 6, and may be provided in a hanged form in the cabinet 1 together with the outer tub 6. A rotating shaft of the washing motor 41 is always coupled with the pulsator 15, and may be coupled or released with or from the inner tub 5 according to a switching operation of a clutch. Accordingly, when the washing motor 41 is operated in a state that the rotating shaft of the washing motor 41 is coupled with the inner tub 5, the pulsator 15 and the inner tub 5 are integrally rotated. When the rotating shaft is separated from the inner tub 5, only the pulsator 15 is rotated in a state that the inner tub 5 stops.

Speed of the washing motor 41 may be controlled and may be controlled under control of the controller 30. It is preferable that the washing motor 41 is a brushless direct current (BLDC) motor. The speed of the BLDC motor may be controlled by using a proportional-integral (PI) controller, or a proportional-integral-derivative (PID) controller. The controllers may vector-control an input current of a motor by receiving water feedback of an output from the motor.

There is a need for at least one pump to exhaust or circulate water in the outer tub 6 through the circulating hose 90. A pump for drainage and a pump for circulation may be separately provided, respectively. However, according to an embodiment, the drainage and the circulation may be selectively performed using one pump 100. The circulating hose 90 guides water pumped from the pump 100 to a circulating nozzle 12. A one end of the circulating hose 90 may be connected to a circulation water exhaustion port 144 and an opposite end of the circulating hose 90 may be connected to the circulating nozzle 12.

The circulation water exhaustion port 144 protrudes in a lateral direction of the pump 100 and is coupled with an end of the circulating hose 90. The circulation water exhaustion port 144 may horizontally extend in an upward inclined direction. In the present embodiment, the circulation water exhaustion port 144 extends backward and upward.

Figure 6:
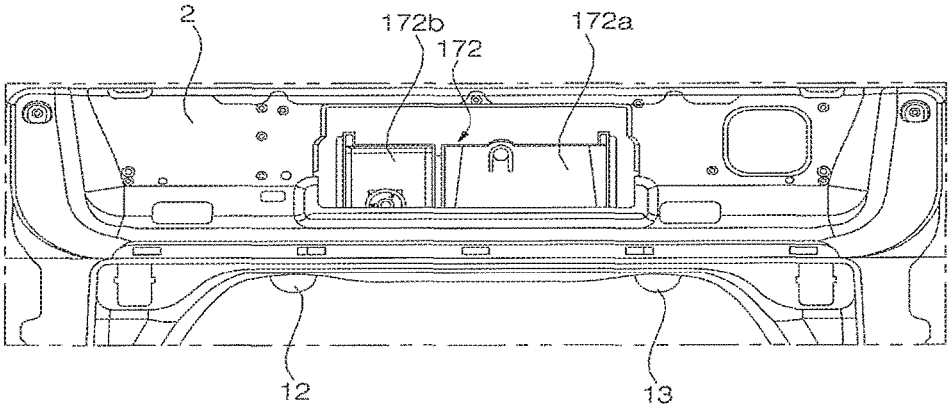
FIG. 6 is a view illustrating a top cover viewed from a top.
Figure 7:
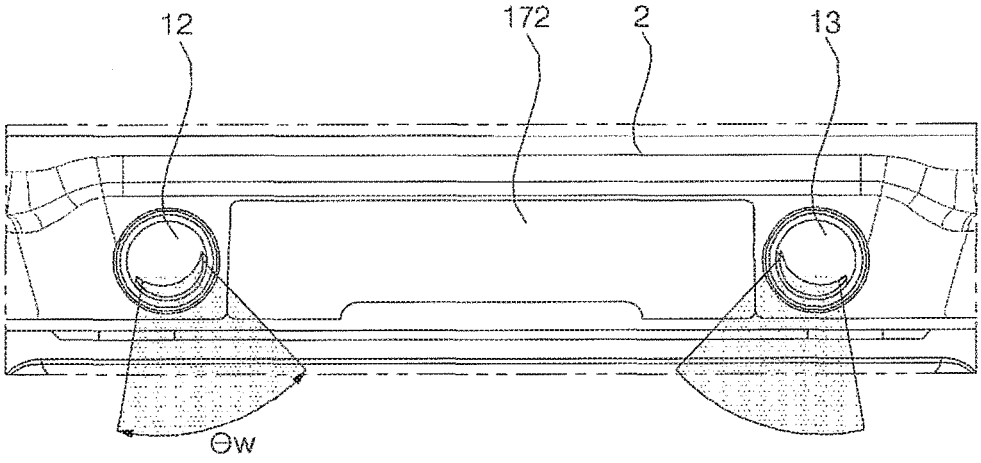
FIG. 7 is a view illustrating a top cover viewed from a front.

The pump 100 may include a pump motor 170 (see FIG. 6) and an impeller 150 which is rotated by the pump motor 170 to pump the water. The pump motor 170 may be rotated in a forward/reverse direction and a rotating direction of the impeller 150 is changed corresponding to a rotating direction of the pump motor 170.

Speed of the washing motor 41 may be controlled and may be controlled under control of the controller 30. It is preferable that the washing motor 41 is a brushless direct current (BLDC) motor. The speed of the BLDC motor may be controlled by a proportional-integral (PI) controller, or a proportional-integral-derivative (PID) controller. The controllers may vector-control an input current of a motor by receiving water feedback of an output from the motor.

The pump 100 may include two ports, that is, the circulation water exhaustion port 144 and a drainage port 143 configured to exhaust the water pumped from the impeller 150. When the pump motor 170 is rotated in a forward direction, the water is exhausted through the circulation water exhaustion port 144. When the pump motor 170 is rotated in a reverse direction, the water is exhausted through the drainage port 143.

A dispenser 17 for supplying additives acting in the laundry into the inner tub 5 together with water may be installed at the top cover 2. The additives supplied from the dispenser 17 may include a detergent and a fiber softener or fabric softener. The dispenser 170 includes a dispenser housing 171 which is provided at an inner side of the top cover 2 and a drawer 171 receives additives and is received in the dispenser housing 171 to be drawn out from the dispenser housing 171. The top cover 2 is formed therein with a drawer entrance through which the drawer 172 passes. An opening portion may be formed at one surface opposed to the drawer entrance in the housing dispenser 171 corresponding to the drawer inlet. An inside of the drawer 172 may be divided into a detergent receiving portion 172*a* for receiving detergent and a fiber softener receiving portion 172*b* for receiving a fiber softener.

A plurality of water supply ports may be formed on a top surface of the dispenser housing 171. The water supply ports may include a first water supply port 171*a* for introducing hot water to be supplied to the detergent receiving portion 172*a*, a second water supply port 171*b* for introducing cold water to be supplied to the detergent receiving portion 172*a*, and a third water supply port 171*c* for introducing the cold water (or hot water) to be supplied to the fiber softener receiving portion 172*b*. Hereinafter, although the cold water is introduced into the third water supply port 171*c* as an example, the hot water may be introduced according to an embodiment.

A washing machine may include one or more water supply hoses for guiding water supplied from an external water source such as a water tap. The water supply hoses may include a first water supply hose for guiding water supplied from a cold water source to a first water supply port 171*a*, a second water supply hose for guiding water supplied from a hot water source to a second water supply port 171*b*, a third water supply hose for guiding the water supplied from the cold water source to a third water supply port 171*c*, and a fourth water supply hose or a direct water supply hose for supplying the water to a direct water nozzle 13.

The cold water may be supplied through the direct water supply hose. The fourth water supply hose may be connected to a water source such as a water tap. The fourth water supply hose may be fluid-connected to the first water supply hose and the third water supply hose. The present disclosure is not limited thereto, and the cold water, the hot water, or a mixing water of the cold water and the hot water may be supplied through the water supply hose.

One or more water supply valves 43 for blocking water supply hoses may be included. For example, the water supply valves 43 may include a first water supply valve for blocking a first water supply hose, a second water supply valve for blocking a second water supply hose, a third water supply valve for blocking a third water supply hose, and a fourth water supply valve for blocking the direct water supply hose. The respective water supply valves may be operated under control of the controller 30.

The washing machine may include a water level sensor 42 for sensing a water level in the outer tub 6. The controller 30 may control a water supply valve 43 and/or a drain valve 44 according to the water level sensed by the water level sensor 42. A control panel or controller 30 may include an input unit 46 such as keys, buttons, and a touch panel capable of setting, selecting, and adjusting various operation modes provided from the washing machine and a display such as a lamp, an LCD panel, and an LED panel to display an operation state of the washing machine and various information such as a response, warning, and alarm according to selection of the operation mode. A memory 47 stores various data necessary to operate the washing machine, and may include various recording media such as volatile/non-volatile RAM, ROM, and a flash memory.

Referring to FIG. 6 to FIG. 10C, the washing machine may include a circulating nozzle 12 and a direct water nozzle 13 as a nozzle for spraying water into the inner tub. The circulating nozzle 12 and the direct water nozzle 13 may be installed at the top cover 2. The circulating nozzle 12 and the direct water nozzle 13 may be provided at both sides of the drawer 172, respectively. The circulating nozzle 12 and the direct water nozzle 13 may be installed at a top side of the outer tub 13. The circulating nozzle 12 may be provided in a rear direction of a top side of the outer tub 6. The circulating nozzle 12 and the direct water nozzle 13 may be installed at the top cover 2. The circulating nozzle 12 and the direct water nozzle 13 may be provided at both sides of the drawer 172, respectively.

When viewed from the front, if both sides with a left side and a right side are divided based on the dispenser 17, the circulating nozzle 12 may be provided at one side of the dispenser 17 and the direct water nozzle may be provided at another side of the dispenser 17. The pump 100 may be provided in the same direction of the circulating nozzle 12 based on the dispenser 17 on the base 9.

When viewed from the front, the circulating nozzle 12 is provided at a left side of the dispenser 17, and the pump 100 is also located in the same direction of the circulating nozzle 12. According to an embodiment, when the circulating nozzle 12 is provided in an opposite direction, that is, a right side of the dispenser 17, the pump 100 may be provided at a right side of the dispenser 17.

The circulating nozzle 12 may include a water supply pipe 121 for guiding water supplied through the circulating hose 90 and a diffuser 122 sprays water released from the water supply pipe 121 by refracting the water downward. The circulating nozzle 12 may be formed by one component of a synthetic resin. The water supply pipe 121 may straightly extend from an inlet 121*a* for introducing water from a direction water supply hose to an outlet 121*b* for exhausting the water to the diffuser 122. It is preferable that a diameter of the outlet 121*b* is smaller than a diameter of the inlet 121*a* so that water pressure exhausted through the outlet 121*b* may be increased.

A radial protrusion 125 may protrude from an outer peripheral surface of the water supply pipe 121. A pair of radial protrusions 125 at symmetrical locations based on a center of the water supply pipe 121. A hose coupling protrusion 126 may protrude from the outer peripheral surface of the water supply pipe 121. A protrusion coupling groove in which the hose coupling protrusion 126 is inserted may be formed at an inner peripheral surface of the circulating hose 10. The circulating nozzle 12 may include a plate 123 which radially extends outward from the outer peripheral surface of the water supply pipe 121. A rear surface of the plate 123 is opposed to a front surface of the top cover 2. The diffuser 122 may be formed at a front surface of the plate 123.

The diffuser 122 may include a collision surface 124 with which the water exhausted through the outlet 121*b* and which is refracted downward. The diffuser 122 includes a spray hole 122*h* which protrudes from a front surface of the plate 123 and sprays the water into the inner tub 5. That is, the diffuser 122 has a chamber or funnel shape recessed from the spray hole 122*h*. The diffuser 122 may have a fluid path cross section gradually increased from the outlet 121*b* of the water supply pipe 121 to the spray hole 122*h*. A part of an inner surface of the diffuser 122 forming a chamber located at a front end of the outlet 121*b* of the water supply pipe 121 is inclined so that the water exhausted from the outlet 121*b* collides with the part to be refracted downward. The inclined part corresponds to the collision surface 124.

The circulating nozzle 20 may include an inclined portion 123*a* which protrudes from the plate 123, extends to the spray hole 122*h* from a top side of the spray hole 122*h*, and has an inclination gradually protruded from the plate 123 in the direction of the spray hole 122*h*. There is an interval between an end of the inclined portion 123*a* and a front surface of the top cover 2. Accordingly, although water passes through the spray hole 122*h* to be fallen after the water flows along the inclined portion 123*a*, the inclined portion 123*a* may prevent the fallen water from making contact with the top cover 2.

A fixing protrusion 128 may protrude from a rear surface of the plate 123. The fixing protrusion 128 may include a pin 128*a* vertically extending from the rear surface of the plate 123 and a head 128*b* having an external diameter greater than that of the pin 128*a* which is formed at an end of the pin 128*a*. The plate 123 may be formed therein with an opening portion 123*h*. The plate 123 may be formed therein with a locking tab 127 which long protrudes from an edge of the opening portion 123*h* into the opening portion 123*h*. The locking tab 127 has a cantilever shape which includes an end located in the opening portion 123*h*. The locking tab 127 may be bent based on a connection part with the plate 123. A pressing protrusion 127*a* may protrude in an oriented direction of the rear surface of the plate 123 in an end of the locking tab 127.

A nozzle mount 2*a* having a shape recessed backward may be formed at a front surface of the top cover 2. The nozzle mount 2*a* may be formed therein with a first installation member h1 and a second installation member h2 having an arc shape circumferentially extending from a center of the first installation member h1 or the water supply pipe 121 to be spaced apart from the first installation member h1.

The first installation member h1 may include a circular water supply pipe insertion section h11 in which the water supply pipe 121 is inserted, first and second radial protrusion insertion sections h12 and h13 radially extending from the water supply pipe insertion section h11 to both sides thereof, and a pressing protrusion insertion section h14 radially extending from the second radial protrusion insertion section h13.

The second installation member h2 may include a head insertion section h21 in which the head 128*b* is inserted when the radial protrusions 125 are inserted into the first and second radial protrusion insertion sections h12 and h13, respectively, and a protrusion guide section h22 circumferentially extending from the head insertion section h21 to have a width smaller than a diameter of the head insertion section h21.

A procedure of installing the circulating nozzle 12 is as follows. After aligning the radial protrusions with the first and second radial protrusion insertion sections h12 and h13, the water supply pipe 121 is inserted into the water supply pipe insertion section h11 from a forward direction of the top cover 2. In this case, a procedure of inserting a head 128*b* of the fixing protrusion 128 into the head insertion section h21 is simultaneously performed. A rear surface of the plate 123 is located on a front surface of the top cover 2. Moreover, a pressing protrusion 127*a* of the locking tab 127 adheres to the front surface of the top cover 2 so that locking tab 127 is elastically bent forward based on a connection part of the plate 123.

Next, if the circulating nozzle 22 is rotated, the head 128*b* is moved along the protrusion guide section h22. During the above procedure, the pressing protrusion 127*a* of the locking tab 127 is turned along the front surface of the top cover 2 while the pressing protrusion 127*a* is modified and reaches a predetermined location, the pressing protrusion 127*a* of the locking tab 127 is inserted into the locking tap insertion section h14 and is recovered to an original shape so that installation of the circulating nozzle 12 is completed.

In a state that installation of the circulating nozzle 12 is completed, the radial protrusion 125 is located on a rear surface of the top cover 2. Accordingly, the circulating nozzle 12 is not separated from a forward direction of the first installation member h1. In addition, since the fixing protrusion 128 is located in the protrusion guide section h22 having a width smaller than a diameter of the head 128*b*, the head 128*b* does not pass through the guide section h22, and the circulating nozzle 12 is not separated from a forward direction of the first installation member h1. Furthermore, a desired spray direction of the circulating nozzle 12 may be configured by suitably designing a length of the protrusion guide section h22 and locations of a locking tab 127 and a corresponding insertion section h14.

Figure 11A:
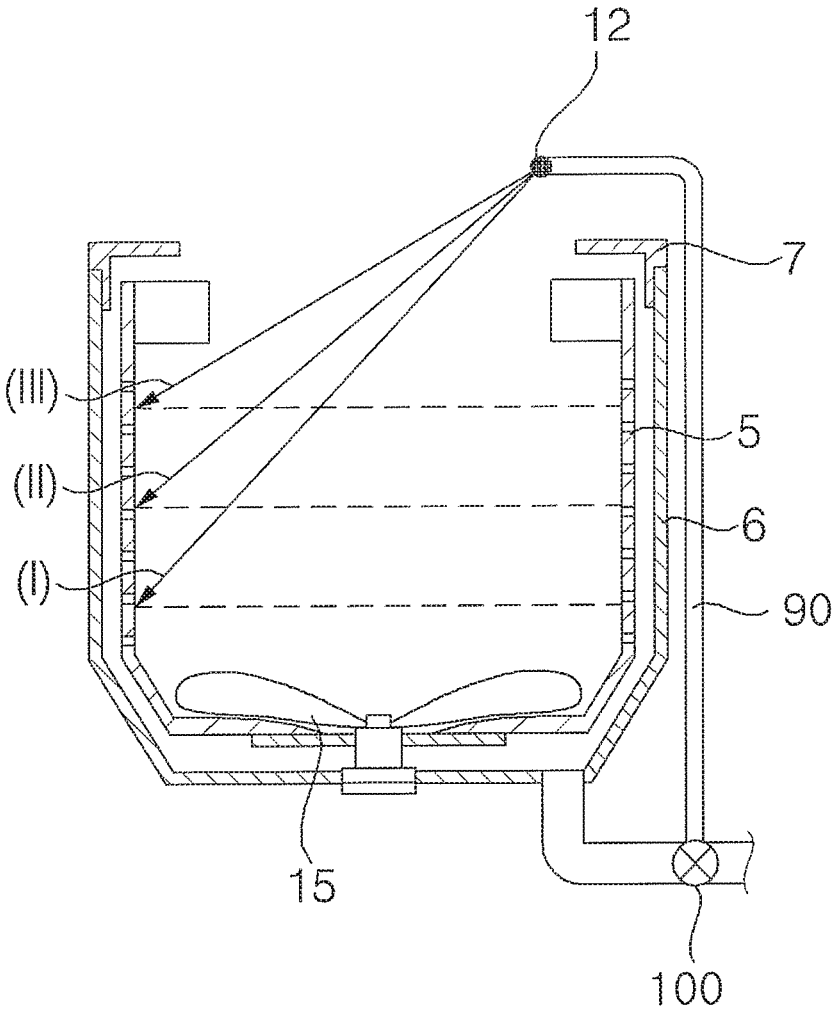
FIG. 11A is a schematic view illustrating a height of water sprayed through a circulating nozzle reaching an inner tub according to rotating speed of a washing motor.
Figure 11B:
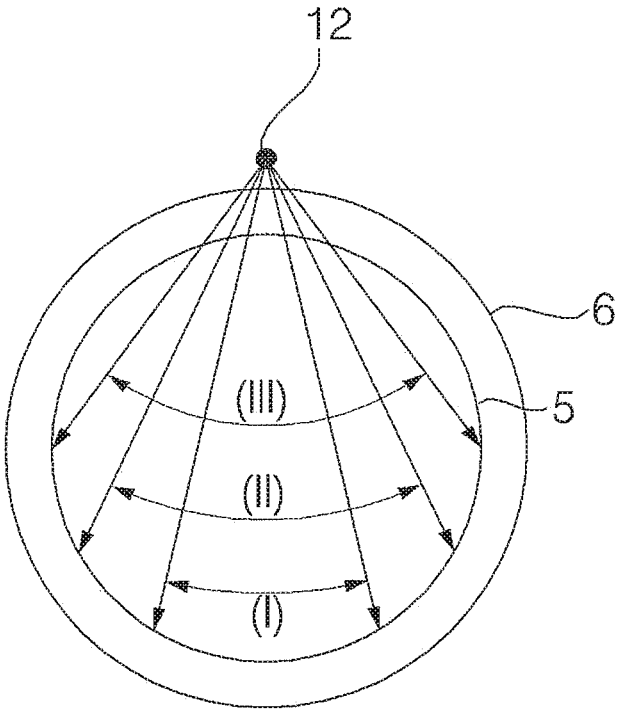
FIG. 11B is a schematic view illustrating an angle of water sprayed through a circulating nozzle to be distributed in a width direction according to rotating speed of a washing motor.
Figure 12:
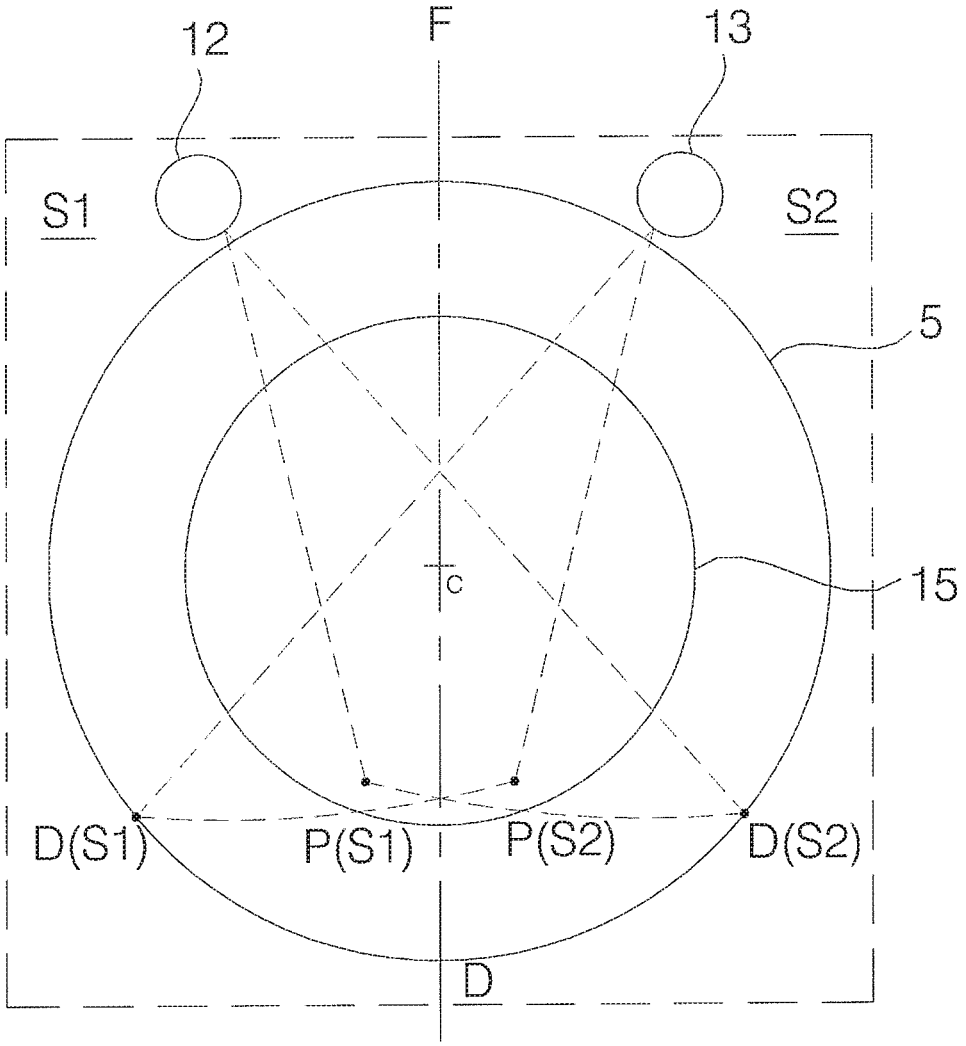
FIG. 12 is a schematic view illustrating a spray range of a circulating nozzle and a direct nozzle.

Referring to FIG. 11A through FIG. 12, when the water is supplied through the water supply pipe 121 with sufficient water pressure, the greatest water sprayed through the spray hole 122*h* is distributed to have a maximum spray width angle θw in left and right directions (see FIG. 7) when viewed from the front. The water sprayed through the spray hole 122*h* may be sprayed to have a maximum vertical spray angle θv with respect to a vertical line when viewed from the lateral side (see FIG. 10). If water pressure supplied through the water supply pipe 121 become low, a width and the greatest height of water stream sprayed through the circulating nozzle 12 are reduced.

Since pressure of the water supplied through the water supply pipe 121 is changed according to rotating speed of the pump motor 170, the controller 30 may control a shape of water stream sprayed through the circulating nozzle by changing the rotating speed of the pump motor 170. That is, in the order of a case where the pump motor 170 is rotated at low speed (I), a case where the pump motor 170 is rotated at intermediate speed (II), and a case where the pump motor 170 is rotated at high speed (III), the greatest height of the water stream sprayed from the circulating nozzle 12 making contact with the inner tub 5 is increased (see FIG. 11A), and a horizontal spray angle of the circulating nozzle 12 is increased (see FIG. 11B).

The controller 30 may include a clothes amount determining module 31 and an operation control module 32. The clothes amount determining module 31 may determine an amount of fabrics (hereinafter referred to as 'clothes amount') received in the inner tub 5. An inertia of the inner tub 5 or the pulsator 15 may be an indicator to determine the clothes amount. For example, since a stop inertia of the inner tub 5 is great if the clothes amount is increased when the inner tub 5 in a stop state is rotated, there is a need for more time until the inner tub 5 reaches preset purpose speed. Accordingly, the clothes amount determining module 31 may determine the clothes amount based on a time taken when the inner tub 5 reaches the purpose speed.

As another example, when the rotated inner tub 5 brakes, the clothes amount determining module 31 may determine the clothes amount based on a time taken until the inner tub 5 stops. The above case uses a rotating inertia of the inner tub 5 changed according to the clothes amount. In addition, the clothes amount may be determined by taking into consideration a variation value of an input or output current and an electromotive force of the washing motor 41. Since a method of calculating the clothes amount is well known in the art, a detailed description thereof is omitted. However, the clothes amount determining module 31 may determine the clothes amount in various schemes which were known in the art.

The operation control module 32 may control various electronic devices such as a washing motor 41, a water supply valve 43, a drain valve 44, and a pump motor 170. The operation control module 32 may control the above devices based on the water level sensed by the water level sensor 42 or the clothes amount determined by the clothes amount determining module 31.

After the water is supplied into the inner tub 5 by control of the water supply valve 43, the operation control module 32 may control rotating speed of the pump motor 170 according to the clothes amount determined by the clothes amount determining module 31. For example, if the clothes amount determined by the clothes amount determining module 31 is great, the operation control module 32 may control rotating speed of the pump motor 170. When the clothes amount introduced into the inner tub 5 is great, the operation control module 32 increases a spray width angle θw and a maximum vertical spray angle θv by increasing spray water pressure of the circulating nozzle 12.

The operation control module 32 may continuously rotate the washing motor 41 in one direction while the pump motor 170 is rotated. In this case, it is preferable that the washing motor 41 is rotated at speed enough to be rotated integrally with the inner tub 5 in a state that fabrics in the inner tub 5 are stuck to an inner surface of the inner tub 5, that is, a drum D (see FIG. 12) by a centrifugal force. The water sprayed through the circulating nozzle 12 may uniformly soak the fabrics.

Figure 8A:
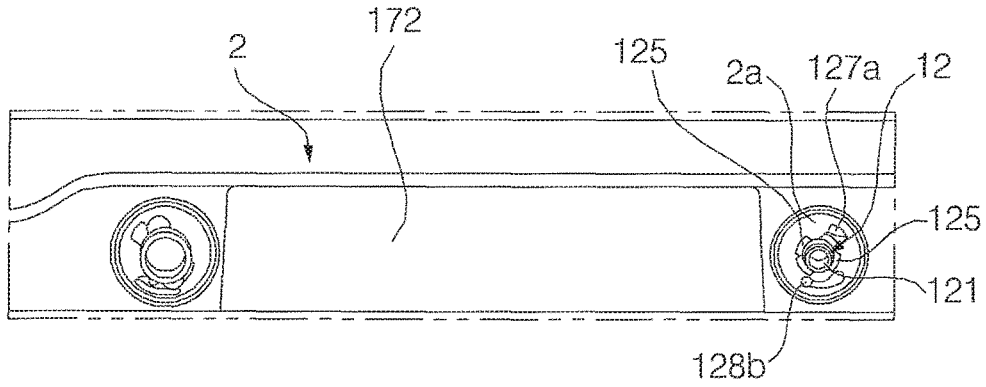
FIG. 8A is a view illustrating a rear surface of a top cover viewed when a circulating nozzle is installed.
Figure 8B:
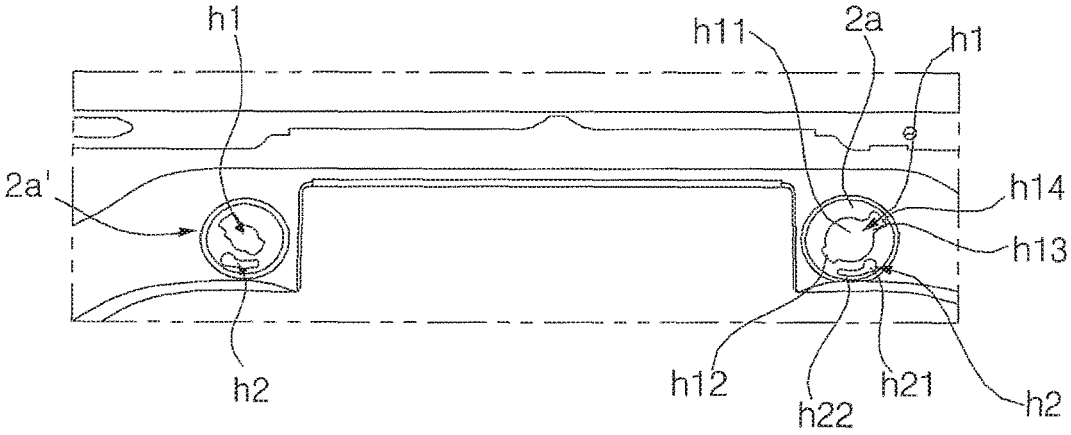
FIG. 8B is a view illustrating a rear surface of a top cover viewed when a circulating nozzle is separated.
Figure 9A:
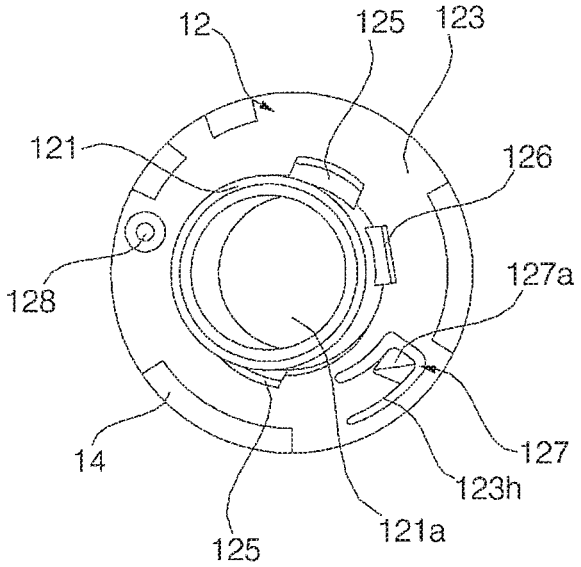
FIG. 9A illustrates a rear surface of a circulating nozzle.
Figure 9B:
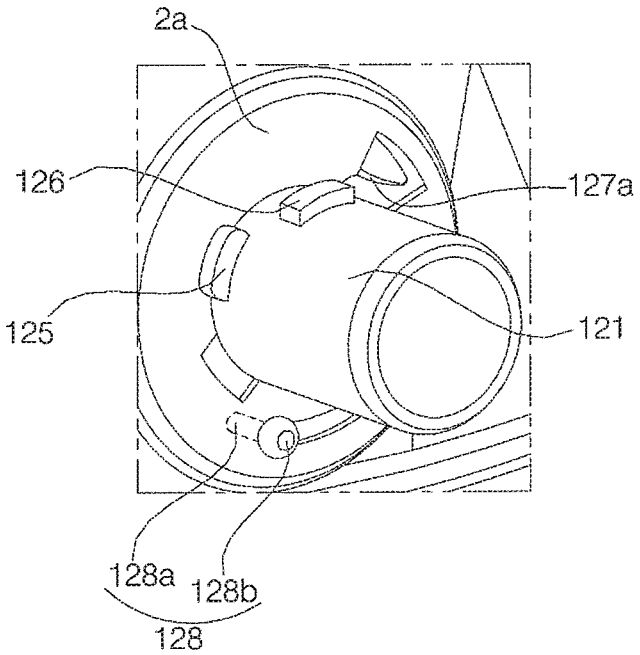
FIG. 9B is a view illustrating a coupling between a top cover and a circulating nozzle.
Figure 10A:
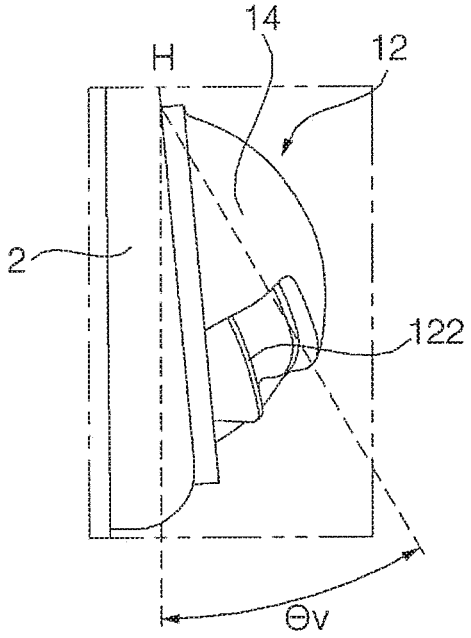
FIG. 10A illustrates a circulating nozzle and a nozzle cap assembly installed at a top cover viewed from a side.
Figure 10B:
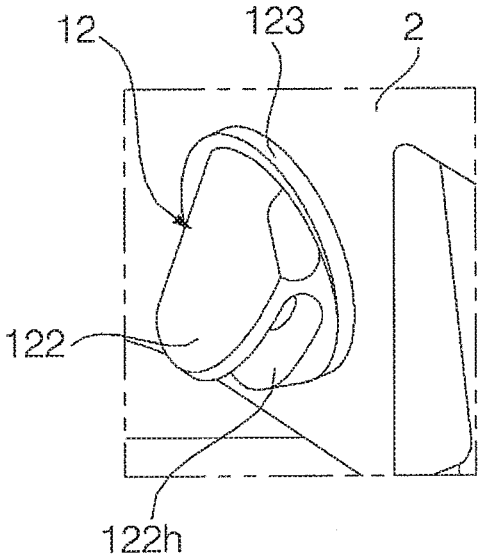
FIG. 10B is a perspective view illustrating a state of a circulating nozzle which is installed at a top cover.
Figure 10C:
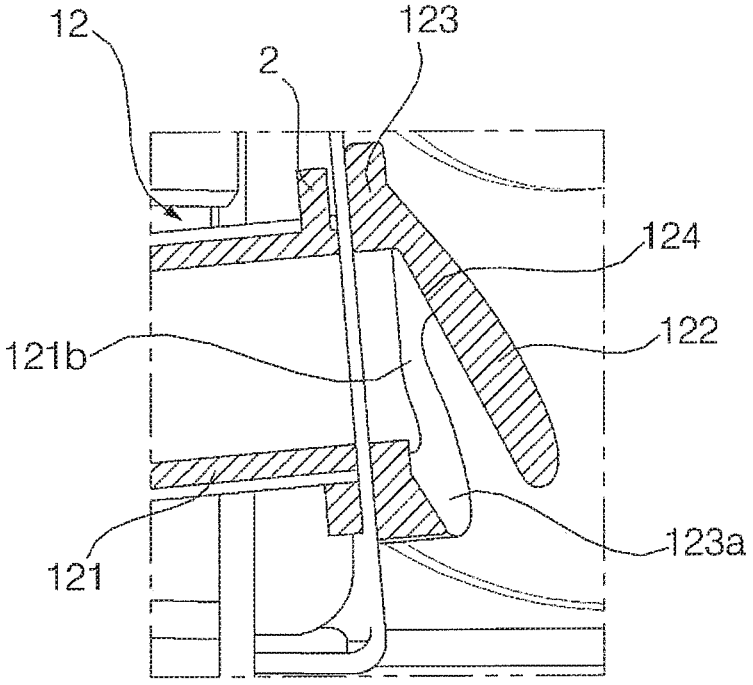
FIG. 10C is a side section illustrating the circulating nozzle.

The direct water nozzle 13 may substantially have the same structure as that of the circulating nozzle 12. The top cover 2 may be formed therein with a nozzle mount 2*a*' for installing the direct water nozzle 13. The nozzle mount 2*a*' substantially has the same structure as that of the nozzle mount 2*a*. As shown in FIG. 8, shapes of the first installation member h1 and the second installation member h2 may be mirror-symmetrical to the nozzle mount 2*a*.

Nozzle caps 14 may be coupled with the circulating nozzle 12 and the direct water nozzle 13, respectively. The nozzle cap 14 surrounds an outer side of a diffuser 122 of each nozzle 12 or 13. The nozzle cap 14 is formed therein with an opening portion communicated with a spray hole of the nozzle 12 or 13. The nozzle cap 14 may be coupled with the plate 123.

Referring to FIG. 12, a rotating axis c of the inner tub 5 is included in a vertical plane. If one side with respect to a reference surface F extending in forward and backward directions is defined as a first region S1 and another side is defined as a second region S2, the circulating nozzle 12 may be provided in the first region S1 to spray water to reach the second region S2, and the direct water nozzle 13 may be provided in the second region S2 to spray the water to reach the second region S1. That is, a spray hole of the circulating nozzle 12 is at least partially opened toward the second region S2. A spray hole of the direct water nozzle 13 is at least partially opened toward the first region S1.

The inner tub 5 may include a floor on which the pulsator 15 is provided and a cylindrical drum which extends upward from the floor. When the inner tub 5 is in an unloaded state, for example, when the fabrics are not introduced, the spray hole of the circulating nozzle 12 may be opened from a first part P(S1) on a top surface of the pulsator 15 included in the first region S1 toward a region corresponding to a second part D(S2) on an inner peripheral surface of the drum included in the second region S2.

When the inner tub 5 is in the unloaded state, the spray hole of the direct water nozzle 13 may be open from a third part P (S2) on a top surface of the pulsator 15 included in the second region S2 toward a region corresponding to a fourth part D (S1) on an inner peripheral surface of the drum included in the first region S1.

Figure 13:
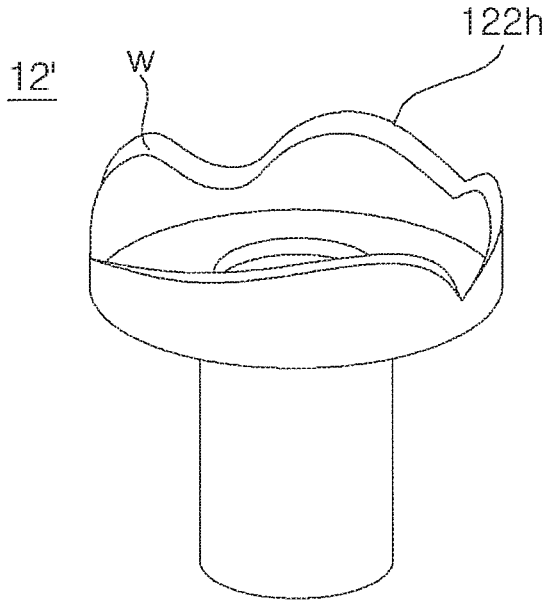
FIG. 13 illustrates a circulating nozzle according to another embodiment.

Referring to FIG. 13, the circulating nozzle 12' according to another embodiment is different from the circulating nozzle 12 according to the above embodiment in that a part of the spray hole 122*h* forms a waveform. Remaining configuration of the circulating nozzle 12' is the same as the circulating nozzle 12. For example, the waveform may be formed at a bottom end of the collision surface 124 configuring the spray hole 122*h*.

Referring to FIG. 14A to FIG. 17B, the pump 100 may include a motor case 130 for receiving the pump motor 170 and a pump housing 140 for forming a space or an 'impeller receiving space' for receiving the impeller 150 inward to be coupled with the motor case 130. The impeller 150 may include a plurality of vanes 151 which are radially provided. In an embodiment, four vanes 151 are included. The number of the vanes 151 is not always limited thereto.

The pump housing 140 may include a housing body 141 for forming an impeller receiving space, a supply port 142 extending forward from the housing body 141 and communicated with the impeller receiving space, and two ports, that is, a circulating water exhaustion port 144 and a drainage port 143 for exhausting water pumped from the impeller 150 to an outside of the impeller receiving space. The circulating water exhaustion port 144 and the drainage port 143 may extend outward from the housing body 141, respectively.

The circulating water exhaustion port 144 and a drainage port 143 may substantially the same diameter as that of the drainage port 143. However, the present disclosure is not limited thereto. The circulating water exhaustion port 144 may have an inner diameter than that of the drainage port 143. The supply port 142 may be connected to a drainage bellows 18. The supply port 142 may be configured as a pipe extending in a rotation axis direction of the impeller 150. The water exhausted from the outer tub 6 to the drainage bellows 18 may pass through the supply port 142 to be supplied to the impeller receiving space.

The pump housing 140 may be formed therein with a drainage exhaustion hole 143*a* corresponding to an inlet of the drainage port 143 on a ring shaped inner surface 147 (see FIG. 15) having a clearance with the impeller 150 and a circulating water exhaustion hole 144*a* corresponding to an inlet of the circulating water exhaustion port 144. The inner surface 147 configures an inner peripheral surface of the housing body 141. The drainage exhaustion hole 143*a* and the circulating water exhaustion hole 144*a* may be circumferentially spaced by a predetermined interval on an inner surface 147. The drainage exhaustion hole 143*a* and the circulating water exhaustion hole 144*a* may be located in the range S of about 140° to 170° based on a rotating axis of the impeller 150. In this case, the range S is an angle formed between one end 144*a*1 of the circulating water exhaustion hole 144*a* and one end 143*a*1 of the drainage exhaustion hole 143*a* based on the rotating axis of the impeller 150. Further, an acute angle may be formed between another end 144*a*2 of the circulating water exhaustion hole 144*a* and another end 143*a*2 of the drainage exhaustion hole 143*a* based on the rotating axis of the impeller 150. An angle θp between the drainage exhaustion port 143 and the circulating water exhaustion port 144 may be in the range of about 30° to 90°.

When the pump motor 170 is rotated in a forward direction, water is applied into the circulating hose 90 through the circulating water exhaustion port 144. When the pump motor 170 is rotated in a reverse direction, the water is applied into the drainage hose 11 through the drainage port 143. In order to exactly perform drainage and a circulating operation of the water, when the water is exhausted through the circulating water exhaustion port 144, exhaustion of the water through the drainage port 143 should be prevented. In contrast, when the water is exhausted through the drainage port 143, exhaustion of the water through the circulating water exhaustion port 144 should be prevented. To this end, the circulating water exhaustion hole 144*a* may be located higher than the drainage exhaustion hole 143*a* in a water upstream side based on the case where the impeller 150 is rotated in a forward direction. Accordingly, the drainage exhaustion hole 143*a* is located at a water downstream side with respect to the circulating water exhaustion hole 144*a*.

The circulating water exhaustion port 144 and the drainage port 143 may extend from the circulating water exhaustion hole 144*a* and the drainage exhaustion hole 143*a* outward of the housing body 141, respectively. The circulating water exhaustion port 144 extends in a forward direction or direction inclined at a downstream side. The drainage port 143 extends in a backward direction or direction inclined at a upstream side with respect to the forward direction.

Figure 14A:
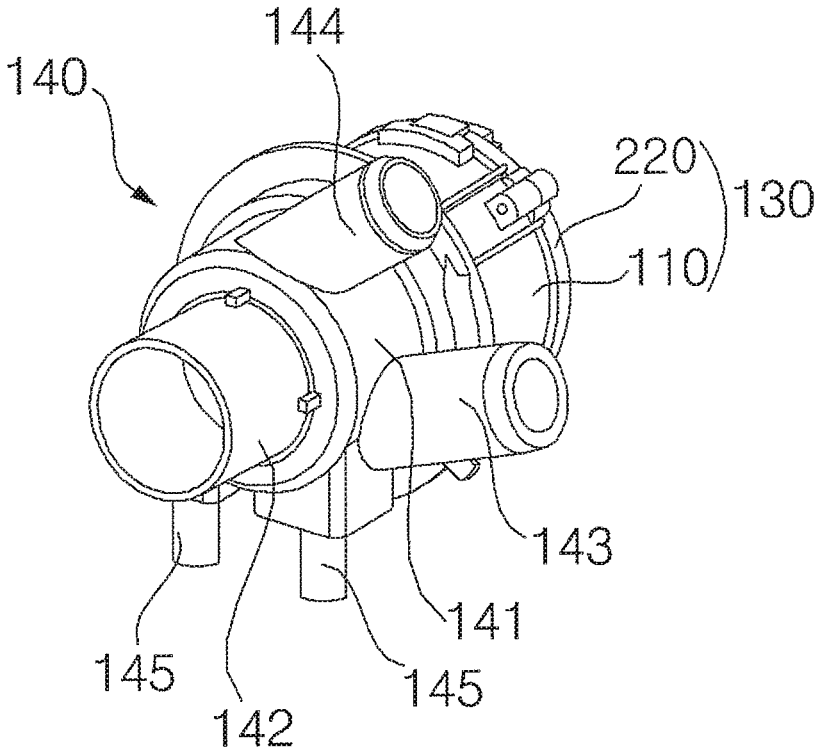
FIG. 14A is a perspective view of a pump.
Figure 14B:
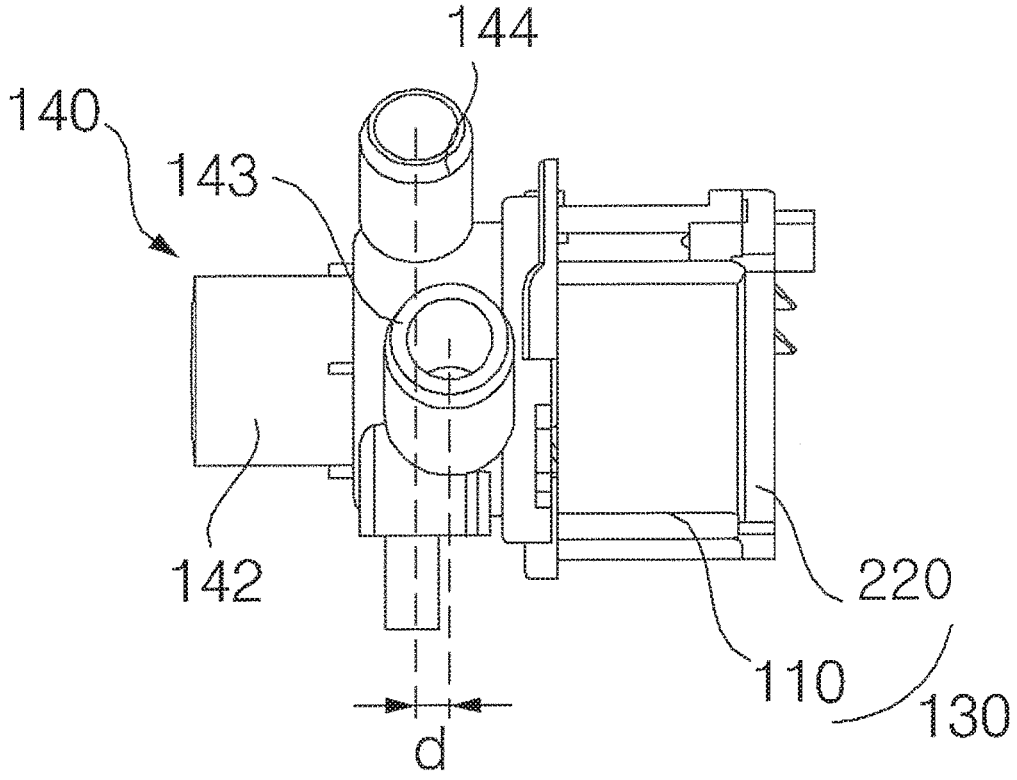
FIG. 14B is a side view of the pump.
Figure 14C:
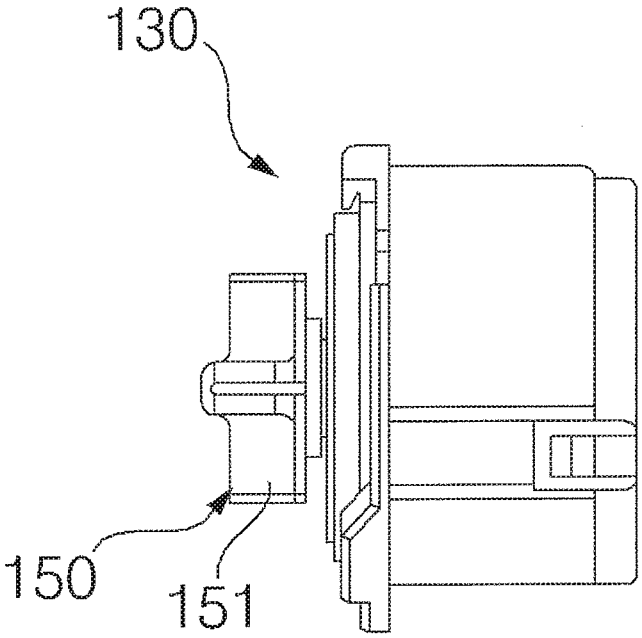
FIG. 14C illustrates a state of a pump where a pump housing is removed from the pump.
Figure 14D:
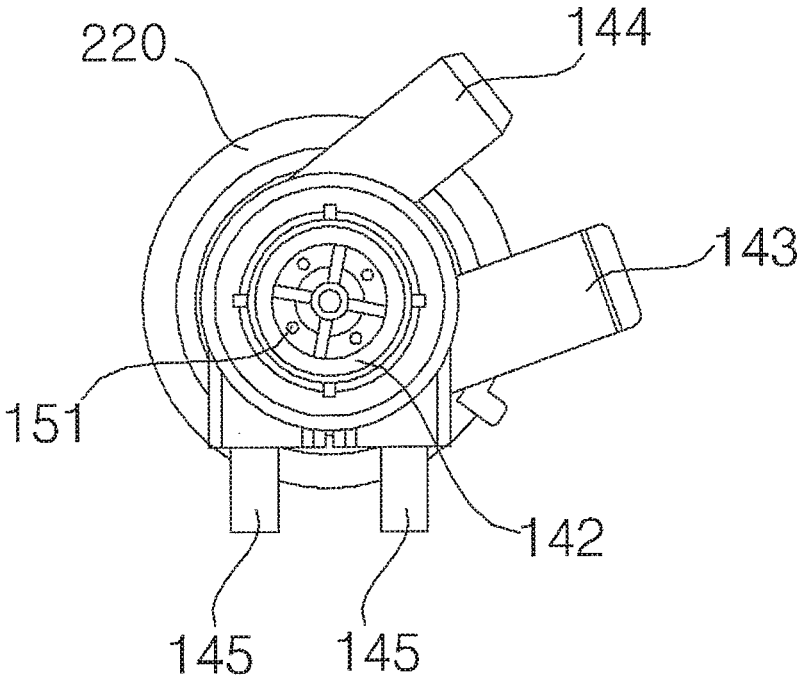
FIG. 14D is a front view of the pump.

As shown in FIG. 14B, when the pump 100 viewed from the lateral side along a rotation axis of the impeller 150, a center of the circulating water exhaustion hole 144*a* is spaced apart from a center of the drainage exhaustion hole 143*a* by a predetermined distance d in a rotating axis direction of the pump motor 170.

When the pump motor 170 is rotated in a forward direction, a drainage prevention rib 146 for preventing the water in the pump housing 140 from being exhausted into the drainage hose 11 through the drainage exhaustion hole 143*a* may protrude from an inner surface 147 of the pump housing 140. When the pump motor 170 is rotated in a reverse direction, a circulating water exhaustion prevention rib 148 for preventing the water in the pump housing 140 from being exhausted into the circulating hose 90 through the circulating water exhaustion hole 144*a* may protrude from the inner surface 147 of the pump housing 140.

Figure 15:
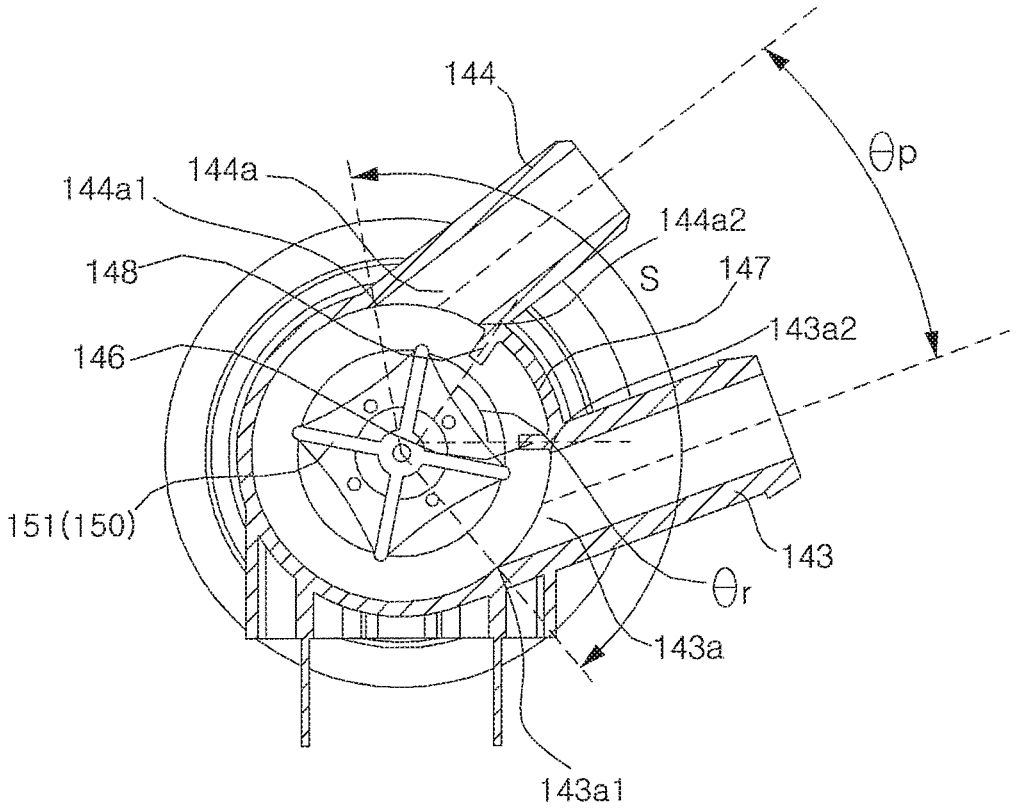
FIG. 15 is a cut-way view illustrating a pump shown in FIG. 14 so that an inside of the pump housing is visible.
Figure 16:
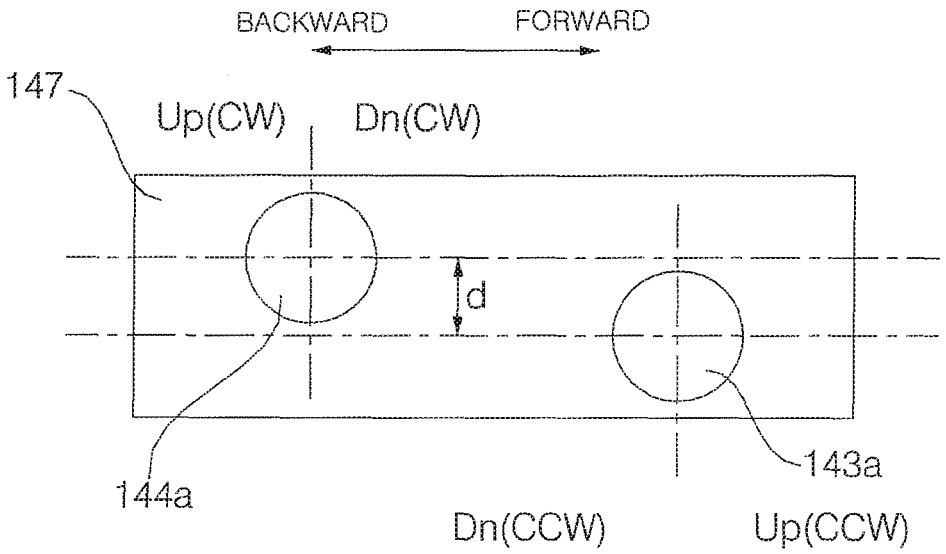
FIG. 16 illustrates an inner surface of the pump housing.
Figure 17A:
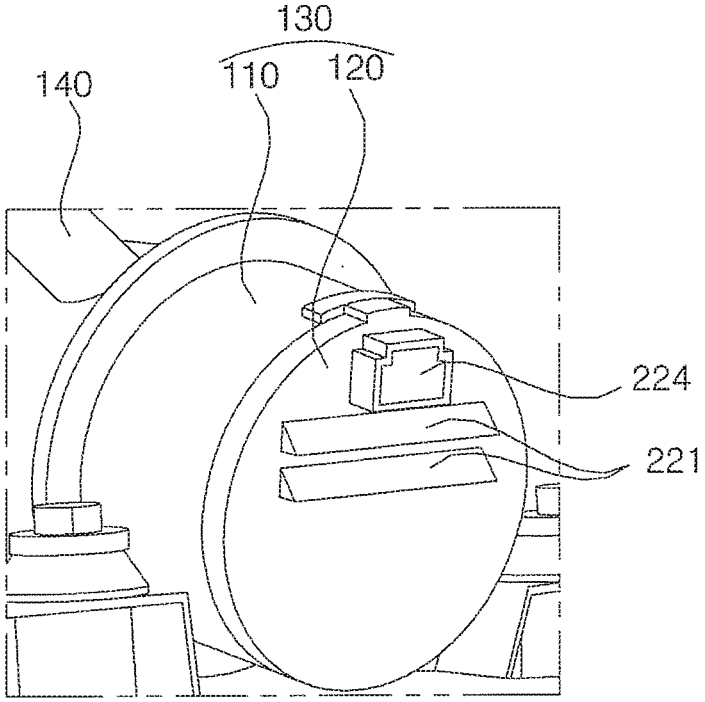
FIG. 17A illustrates a rear surface of the pump.
Figure 17B:
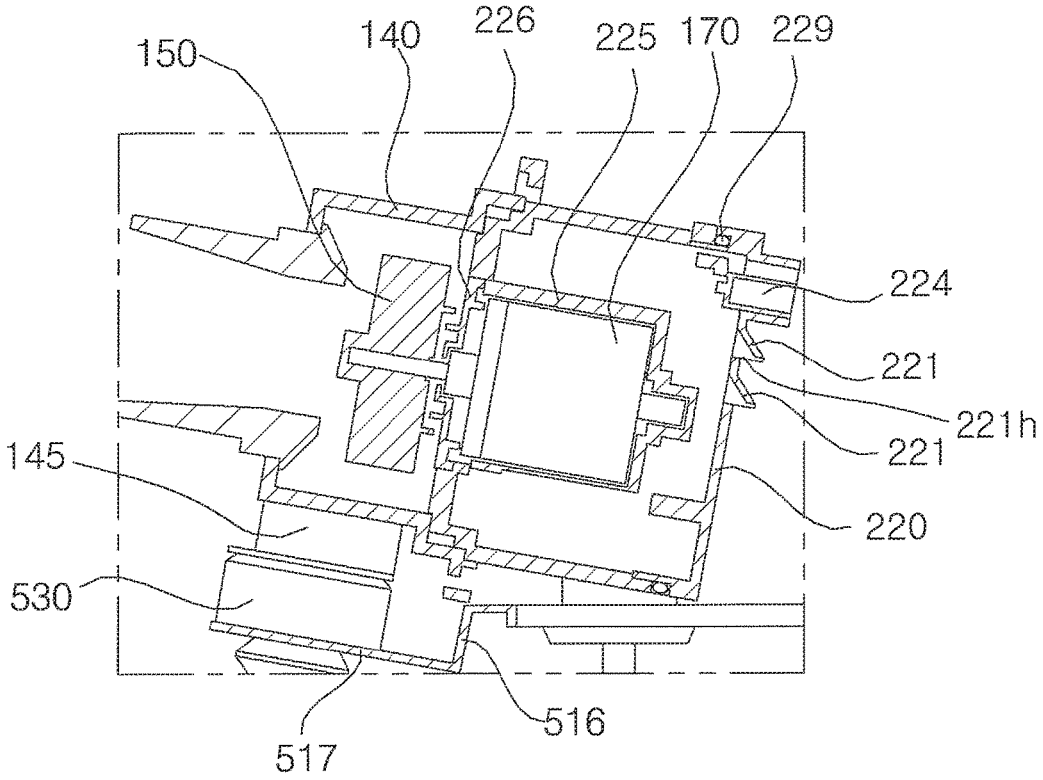
FIG. 17B is a side section of the pump.

FIG. 16 illustrates an inner surface of the pump housing where an upstream side Up(CW) and a downsteam side Dn(CW) of the circulating water exhaustion hole 144*a* are defined based on a water stream when the pump motor 170 is rotated in the forward direction, and an upstream side Up(CCW) and a downsteam side Dn(CCW) of the drainage exhaustion hole 143*a* are defined based on a water stream when the pump motor 170 is rotated in the reverse direction. According to the above definition, the drainage prevention rib 146 may be formed close to the drainage exhaustion hole 143*a* in the downsteam side Dn(CCW) and the circulating water exhaustion prevention rib 148 may be formed close to the circulating water exhaustion hole 144*a* in the downsteam side Dn(CW) in FIG. 15.

The drainage prevention rib 146 may be formed at an edge of the drainage exhaustion hole 143*a*, and the circulating water exhaustion prevention rib 148 may be formed at an edge of the circulating water exhaustion hole 144*a*. The drainage prevention rib 146 and the circulating water exhaustion prevention rib 148 are formed within an interval between the impeller 150 and an inner surface 147 of the pump housing 140, respectively. Ends of the ribs 146 and 148 are spaced apart from a vane 151 of the impeller 150 by a predetermined distance.

At least one of the drainage prevention rib 146 and the circulating water exhaustion prevention rib 148 may protrude from an inner surface 147 of the pump housing 140 by a length of about 3 to 6 mm. Accordingly, the distance between the impeller 150 and the inner surface 147 of the pump housing 140 should be greater than the protrusion length.

For example, at least one of the drainage prevention rib 146 and the circulating water exhaustion prevention rib 148 may form an acute angle with the inner surface 147 of the pump housing 140. Particularly, an angle θr between the drainage prevention rib 146 and the circulating water exhaustion prevention rib 148 may be in the range of 75° to 85°. The drainage prevention rib 146 and the circulating water exhaustion prevention rib 148 may vertically protrude from the inner surface 147 of the pump housing 140, as compared with a case where an angle between the drainage prevention rib 146 and the circulating water exhaustion prevention rib 148 is 40°, as shown in FIG. 15, an oblique angle is formed between the drainage prevention rib 146 and the circulating water exhaustion prevention rib 148 and the inner surface 147 of the pump housing 140. When an angle between the drainage prevention rib 146 and the circulating water exhaustion prevention rib 148 is 80°, an amount of the water leaked into the exhaustion port 144/drainage port 143 may be reduced during drainage/circulation.

The motor case 130 may be coupled with the pump housing 140. The pump housing 140 is formed therein with an opening portion at an opposite side of a supply port 142. The motor case 130 is coupled with the pump housing 140 so that the opening portion may be blocked. A ring type sealer 229 may be interposed along a coupling part between the motor case 130 and the pump housing 140.

The motor case 130 may include a case body 110 and a rear cover 220. The case body 110 may be provided therein with a motor housing 225 which receives a pump motor 170 at an inner side thereof. The motor case 130 may have a cylindrical shape which extends from a front portion through which the rotating axis of the motor 170 passes backward. An open rear end of the motor housing 225 may be coupled with the rear cover 220. A front surface of the motor housing 225 may be opened so that the pump motor 170 may be inserted into the motor housing 225. The open region of the motor housing 225 may be coupled with a front surface of the case body 110.

One or more radiating holes 221*b* may be formed in the rear cover 220. A shielding plate 221 for shielding falling water from being introduced into the radiating hole 221*h* may be formed at a top side of the radiating hole 221*h*. The shielding plate 221 may be inclined downward. Further, the rear cover 220 may be formed therein with a power connector 224 for connecting the pump motor 170 to a power line.

Figure 18:
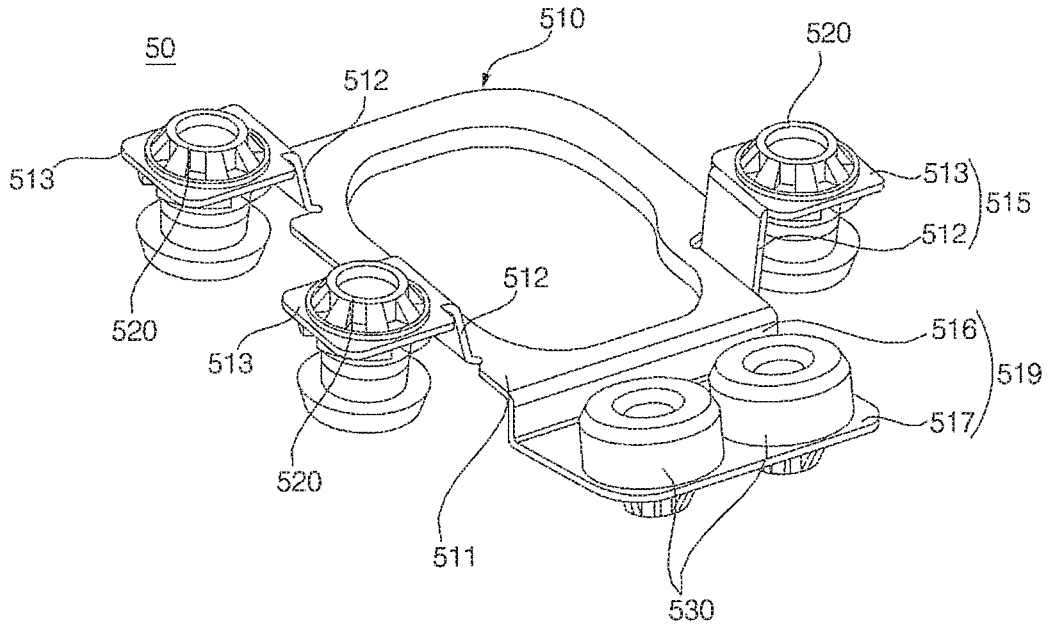
FIG. 18 is a perspective view illustrating a pump bracket.
Figure 19:
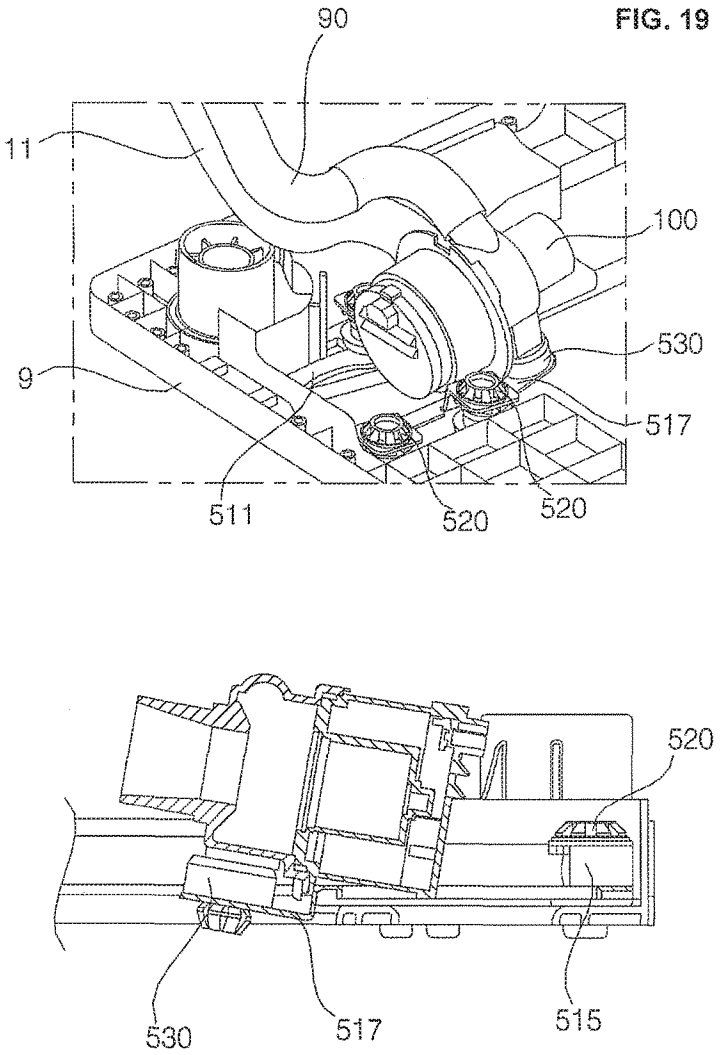
FIG. 19 illustrates a plurality of lateral sides of a pump installed on a base.

Referring to FIG. 18 and FIG. 19, the pump 100 may be coupled with a base 8 by a pump supporter 50. The pump supporter 50 may include a plate 510 of a metallic material, a plate support damper 520 installed on the plate 510, and a pump support damper 530 installed on the plate 510 to support a bridge which formed at the pump 10. Three plate support dampers 520 may be included for a triangular pattern. The plate support damper 520 and/or the pump support damper 530 may be made of elastic materials such as rubber. Accordingly, vibration occurring during an operation of the pump 100 may be buffered by the plate support damper 520 and the pump support damper 530.

The plate 510 may include a horizontal flat part 511, a plate support damper mount 515 extending upward from the flat part 511, and a pump support damper mount 519 extending downward from the flat part 511. The plate support damper mount 515 may include an upper vertical portion 512 bent upward from the flat part 511, and an upper horizontal portion 513 formed therein with a hole in which the plate support damper 520 is installed. In a state that the plate support damper 520 is fixed on the upper horizontal portion 513, a bottom end of the plate support damper 520 is coupled with the base 8.

The pump support damper mount 519 may include a lower vertical portion 516 bent downward from the flat part 511, and a lower horizontal portion 517 formed therein with a hole in which the pump support damper 530 is installed. The pump 100 may include a pair of bridges 145 which protrude downward from the pump housing 140. In a state that the pump support damper 530 is fixed on the lower horizontal portion, a top end of the pump support damper 530 is coupled with a bridge 145 of the pump 100.

Figure 20:
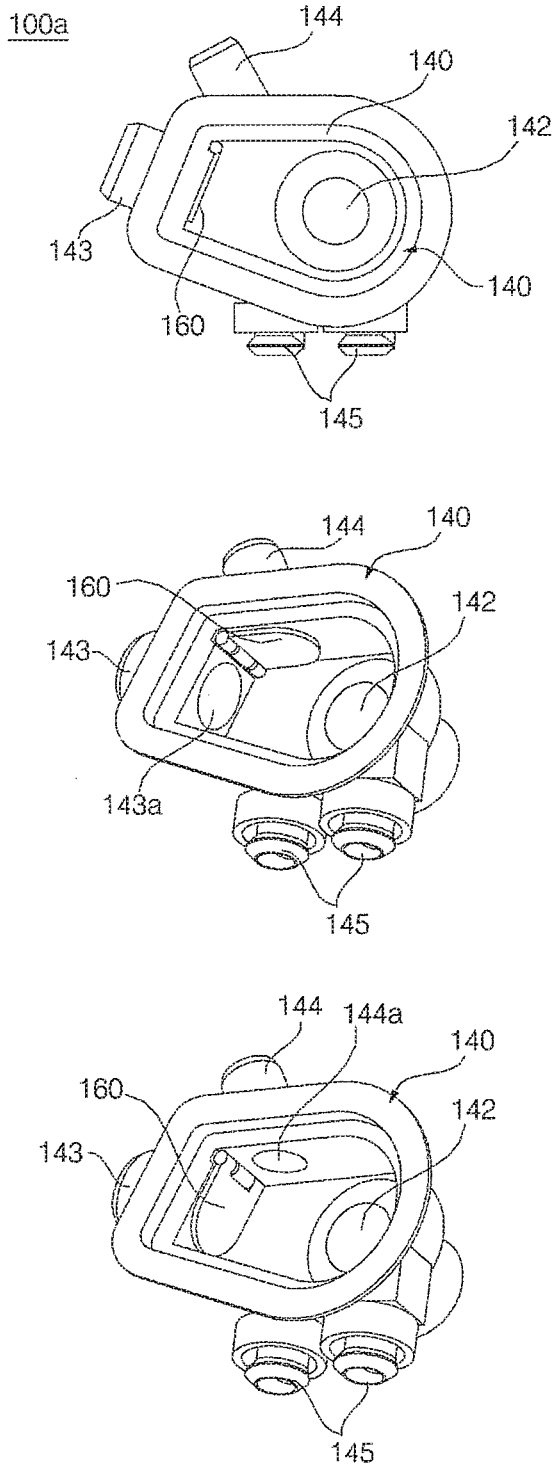
FIG. 20 illustrates a pump according to another embodiment.

FIG. 20 illustrates a pump according to another embodiment. Hereinafter, same components may be assigned with the same reference numerals in the above embodiments, and repetition in the description about the same components will be omitted in order to avoid redundancy. Referring to FIG. 20, a pump 100*a* may include a check valve 160 rotatably connected to an inner surface 147 of the pump housing 140, and to close the drainage exhaustion hole 143*a* when the pump motor 170 is rotated in a forward direction, and to close the circulating water exhaustion hole 144*a* when the pump motor 170 is rotated in a reverse direction.

The check valve 160 is operated by water stream formed by the impeller 150. A rotating axis connected to an inner surface 147 of the pump housing 140 is substantially formed parallel to a rotating axis of the impeller 160. The rotating axis of the pump housing 140 may be located between the circulating water exhaustion hole 144*a* and the drainage exhaustion hole 143*a*. Accordingly, a rotating direction of the impeller 160 is opposed to a rotating direction of the check valve 160. Since the drainage exhaustion hole 143*a* is located at a water downstream as compared with the circulating water exhaustion hole 143*a* based on the case where the impeller 160 is rotated in a forward direction, the drainage exhaustion hole 143*a* maintains a closed state by the check valve 160. In this state, the rotating direction of the impeller 160 is changed to a reverse direction, the check valve 160 is rotated in the forward direction so that the drainage exhaustion hole 143*a* is opened and the circulating water exhaustion hole 144*a* is opened.

The check valve 160 may be made of a soft material such as rubber having a predetermined elasticity. A surface of the check valve 160 making contact with the inner surface of the pump housing 140 may be flat. Further, the inner surface 147 of the pump housing 140 may be formed horizontally to a peripheral portion of the circulating water exhaustion hole 144*a* and a peripheral portion of the drainage exhaustion hole 143*a* making contact with the check valve 160.

Since the check valve 160 closes the drainage exhaustion hole 143*a* and the circulating water exhaustion hole 143*a* corresponding to the rotating direction of the pump motor 170, unexpected leakage from the drainage pump 100*a* may be prevented.

Figure 21A:
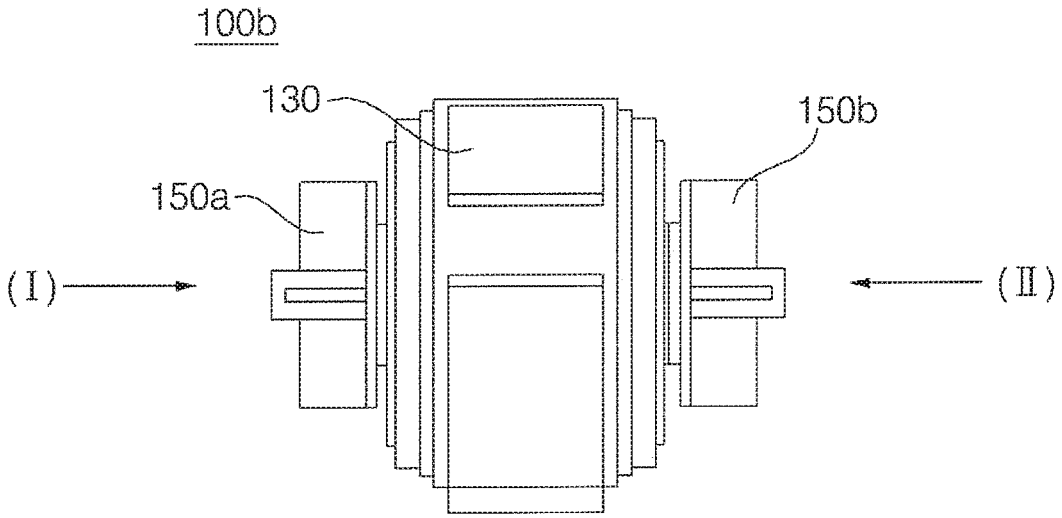
FIG. 21A illustrates a pump where a first pump housing and a second pump housing are removed from the pump.
Figure 21B:
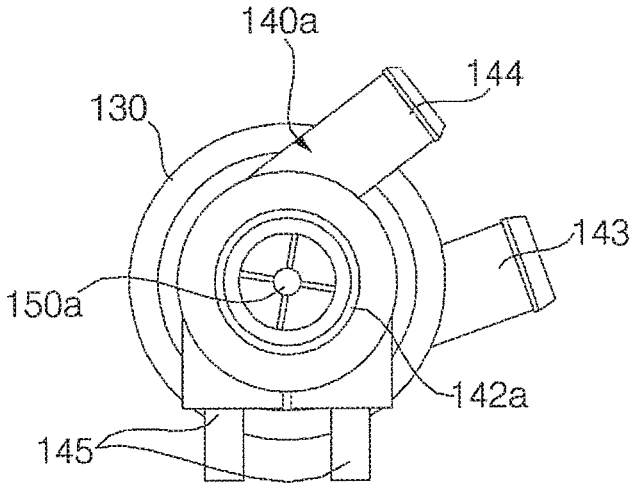
FIG. 21B illustrates an assembled state of the first pump housing and a second pump housing viewed from an (I) direction shown in FIG. 21A.
Figure 21C:
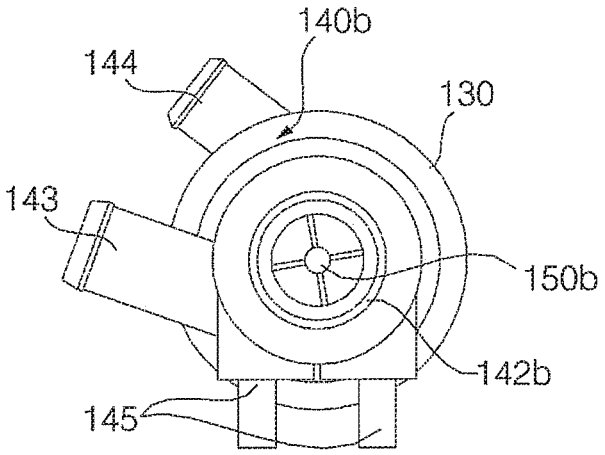
FIG. 21C illustrates an assembled state of the first pump housing and a second pump housing viewed from an (II) direction shown in FIG. 21A.
Figure 22A:
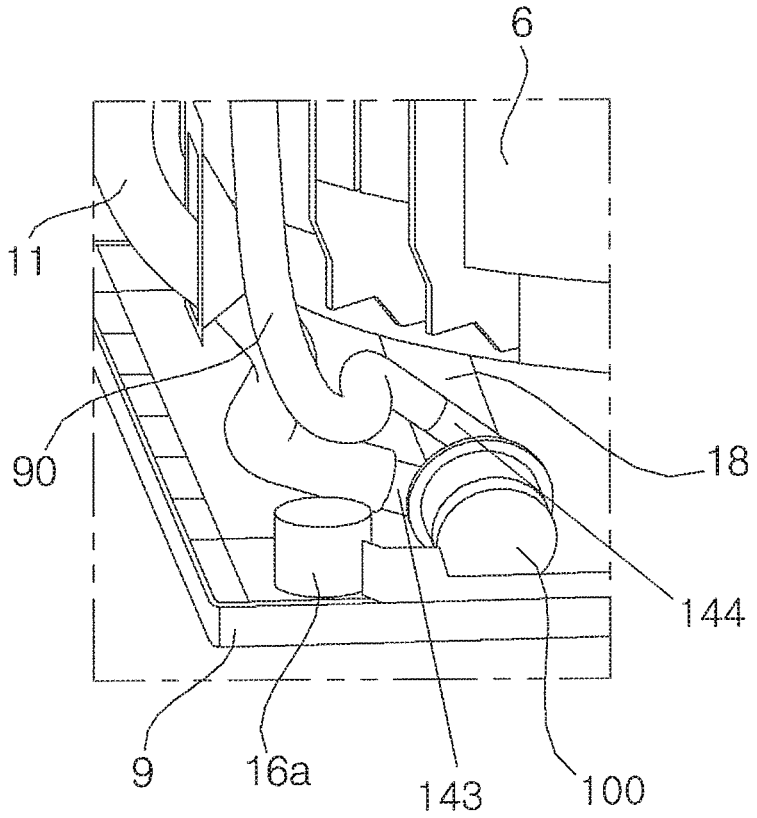
FIGS. 22A and 22B are partial perspective views illustrating a relationship between a bottom end of a circulating hose and peripheral constituent elements shown in FIG. 2.
Figure 22B:
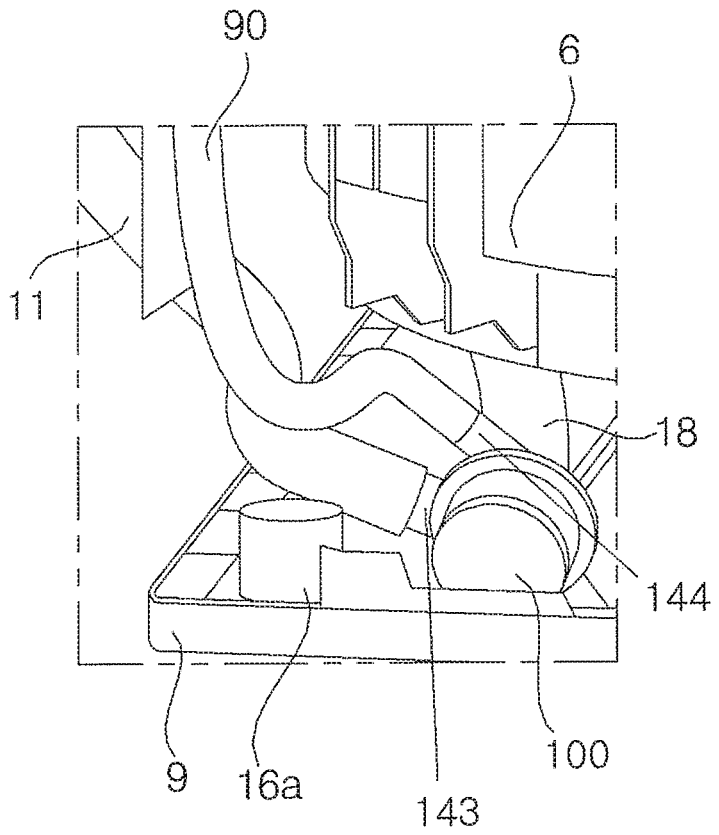
Figure 23:
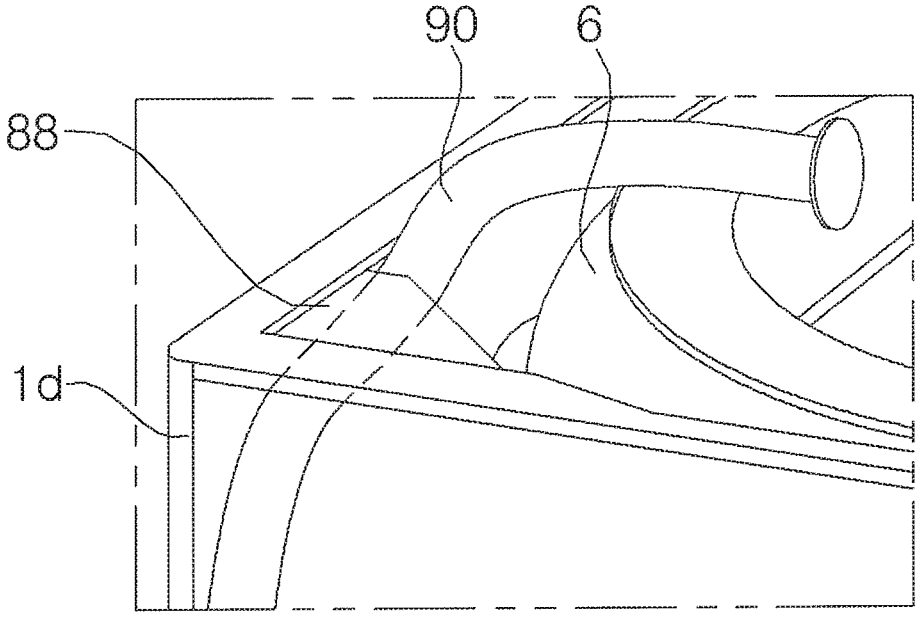
FIG. 23 is a partial perspective view illustrating a relationship between a top end of a circulating hose and peripheral constituent elements shown in FIG. 2.
Figure 24:
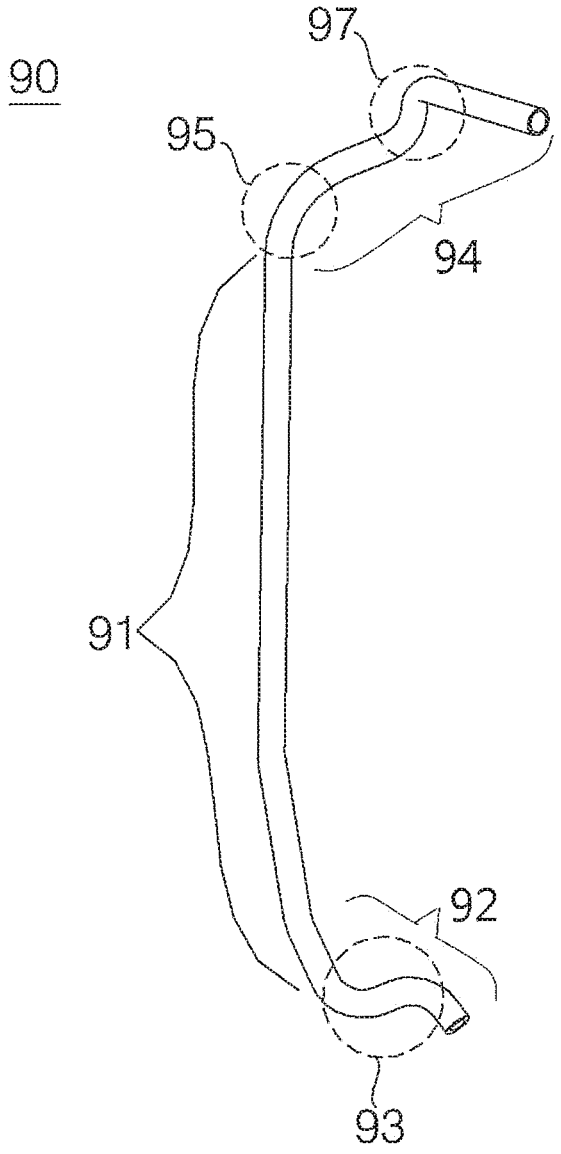
FIG. 24 is a perspective view illustrating a circulating hose shown in FIG. 2.

Referring to FIG. 21A, a pump 100*a* includes a pump motor configured by a stepping motor. Each shaft of the stepping motor may be coupled with impellers 150*a* and 150*b*. The stepping motor is a two shaft motor. Each shaft is aligned on the same line, and is rotated by a common rotor. The pump 100*b* may include a first pump housing 140*a* and a second pump housing 140*b* for receiving a first impeller 150*a* and a second impeller 150*b*. The first pump housing 140*a* and the second pump housing 140*b* may be coupled with both sides of the pump case 130, respectively.

At least one of the first pump housing 140*a* and the second pump housing 140*b* may be formed therein with supply ports 142*a* and 142*b*. In an embodiment, a first supply port

142*a* and a second supply port 142*b* are formed in the first pump housing 140*a* and the second pump housing 140*b*, respectively so that water exhausted through the drainage bellows 18 is supplied to the first supply port 142*a* and the second supply port 142*b*. However, the present disclosure is not limited thereto. The first pump housing 140*a* communicates with the second pump housing 140*b* so that the water may be supplied into the first pump housing 140*a* and the second pump housing 140*b* through one supply port.

A circulating water exhaustion port 144 may be formed in the first pump housing 140*a* and a drainage exhaustion port 143 may be formed in the second pump housing 140*b*. The circulating water exhaustion port 144 and the drainage port 143 may be formed by substantially the same structure according to the above embodiments. The circulating water exhaustion port 144 and the drainage port 143 are different from those of the above embodiments in that the circulating water exhaustion port 144 and the drainage port 143 are formed in the first pump housing 140*a* and the second pump housing 140*b* instead of one common pump housing. The drainage port 143 may not be formed in the first pump housing 140*a* and the circulating water exhaustion port 144 may not be formed in the second pump housing 140*b*.

When the pump motor is rotated in a forward direction, water pumped from the first impeller 150*a* is exhausted through the circulating water exhaustion port 144. In contrast, when the pump motor is rotated in a reverse direction, water pumped from the second impeller 150*b* is exhausted through the drainage port 143.

Referring to FIG. 22A to FIG. 24, a circulating hose 90 may be provided inside a cabinet 1. The circulating hose 90 may be provided around an inner corner of the cabinet 1. The circulating hose 90 may be provided around an inner corner of inner corners of the cabinet 1 which is located in a rear direction. The circulating hose 90 may include an upward extending part 91 which extends upward. The water pumped from the pump 100 flows upward from a bottom of the upward extending part 91. In the present embodiment, the upward extending part 91 extends to a lower side of a hanger bracket 88 fixed at an inner side of a corner configured upward by a lateral side 1*c* and a rear surface 1*d* (see FIG. 2 and FIG. 3).

The upward extending part 91 may be located around a corner of the cabinet 1. The pump 100 may be provided at a lower side of the cabinet 1. In this case, the upward extending part 91 may be provided around a corner of the inner corners of the cabinet 1 which is located in a backward direction of the lower side of the cabinet 1. Alternatively, the upward extending part 91 may be provided in the same direction as the circulating nozzle 12 based on the dispenser 17. The circulating hose 90 may include a pump connecting part 92 for connecting a bottom end of the upward extending part 91 to the pump 100, and a nozzle connecting part 94 for connecting a top end of the upward extending part 91 to the circulating nozzle 12.

A shape of the pump connecting part 92 is described in a flow direction of water as follows. The pump connecting part 92 may extend backward from the pump 100, is rounded in one of both lateral directions to horizontally extend, and is rounded upward to be connected to a bottom end of the upward extending part 91. The lateral direction is a direction toward one of two lateral sides 1*b* and 1 *c*. For example, a part of the pump connecting part 92 extending backward from the pump 100 is upwardly inclined.

The pump connecting part 92 may extend backward to be upwardly inclined, may be rounded in an adjacent inner corner of inner corners of the cabinet 1 to substantially and horizontally extend, and may be rounded upward to be connected to a bottom end of the upward extending part 91. In an embodiment where the upward extending part 91 is provided in one of the inner corners of the cabinet 1, the pump connecting part 92 extends to be upwardly inclined backward from the pump 100, is rounded in a direction of the inner corner in which the upward extending part 91 is provided to horizontally extend, and is rounded upward to be connected to a bottom end of the upward extending part 91.

A shape of the nozzle connecting part 94 is described in a flow direction of water as follows. The nozzle connecting part 94 is rounded in a different one of both lateral directions from a top end of the upward extending part 91 to horizontally extend, is rounded upward to extend, and is rounded forward to be connected to the circulating nozzle 12. The different one of the both lateral directions means a remaining one direction different from a bent direction of the pump connecting part 92 of the both lateral directions.

In another embodiment, the nozzle connecting part 94 is rounded in a direction opposite to an adjacent inner corner direction of the inner corners of the cabinet 1 from a top end of the upward extending part 91 to horizontally extend, is rounded upward to extend, and is rounded forward to be connected with the circulating nozzle 12. In an embodiment where the upward extending part 91 is provided in one of the inner corners of the cabinet 1, the upward extending part 91 is rounded in a direction opposite to the inner corner direction to horizontally extend, is rounded upward to extend, and is rounded forward to be connected to the circulating nozzle 12.

Characteristics of the circulating hose 90 are described based on a disposing relationship between peripheral constituent elements as follows. The circulating hose 90 may include a first curved part 93 which is connected to the circulating water exhaustion port 144 to be rounded at least once in a corner direction in which the upward extending part 91 is provided from a protrusion direction of the circulating water exhaustion port 144, and is rounded at least once upward from the corner direction to be connected to a bottom end of the upward extending part 91.

The circulating hose 90 may include a second curved part 95 which is connected to a top end of the upward extending part 91 to be rounded at least once in a direction close to the circulating nozzle 12. The second curved part 95 is horizontally rounded along one of a front surface 1*a*, both lateral surfaces 1*b* and 1*c*, and a rear surface 1*d* to extend close to the circulating nozzle 12. In another embodiment, the second curved part 95 is horizontally rounded along the rear surface 1*d* from a lower side of a hanger bracket 88 to extend a part close to a rear surface 1*d* in a backward direction of the circulating nozzle 12.

The circulating hose 90 may include a third curved part 97 which is rounded at least once upward from a downstream side of the second curved part 95 to extend to a height of the circulating nozzle 12, and is rounded at least once in a direction of the circulating nozzle 12 to be connected with the circulating nozzle 12. The whole circulating hose 90 may be integrally formed by the same material or the circulating hose 90 may be formed so that materials of both ends 90*a* and 90*c* are different from that of a section 90*b* between both ends 90*a* and 90*c*. In an embodiment, the whole circulating hose 90 may be formed by a rubber material such as ethylene propylene diene monomer (EPDM).

Figure 25:
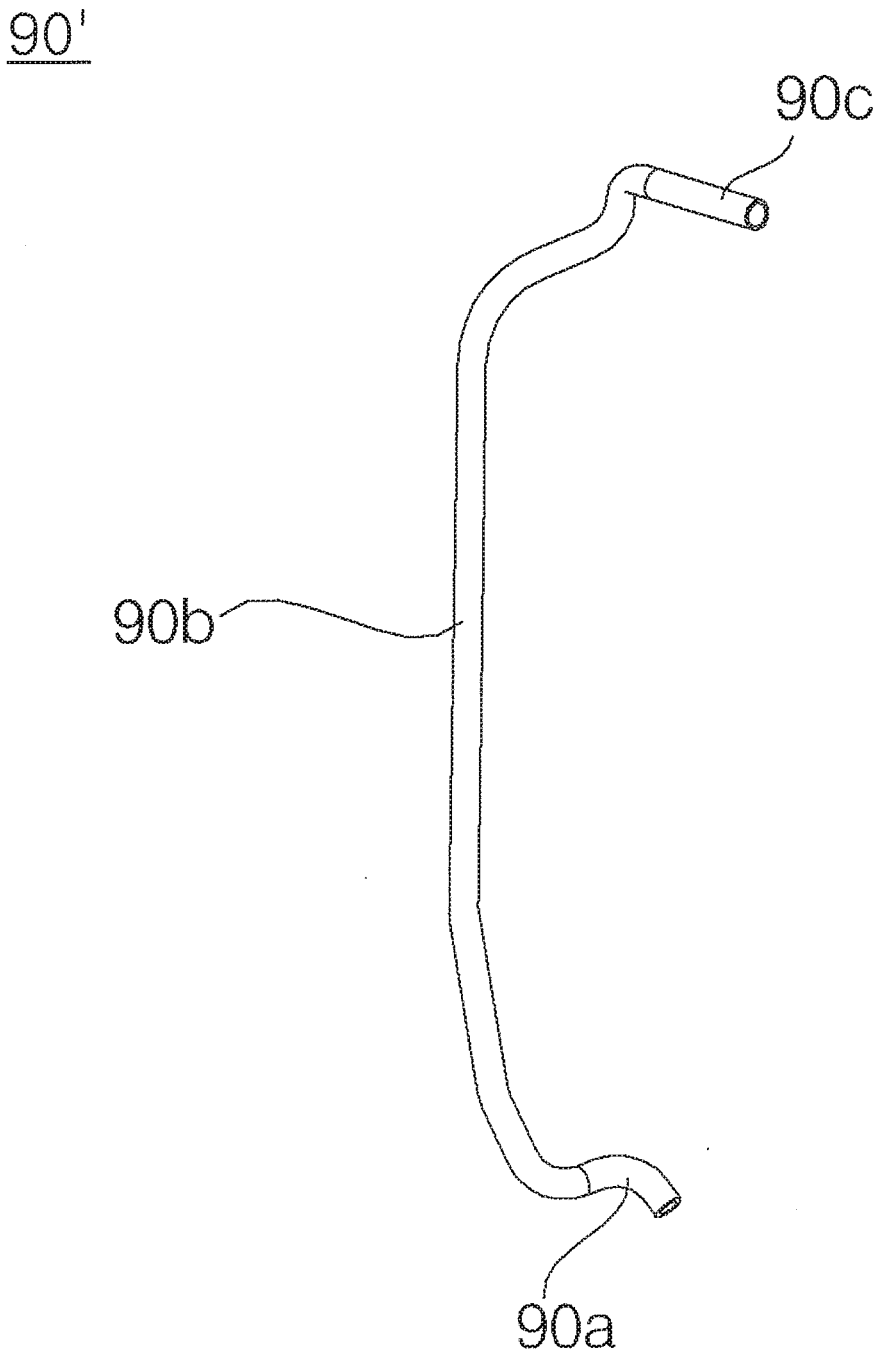
FIG. 25 is a perspective view illustrating a circulating hose according to another embodiment.

Referring to FIG. 25, the circulating hose may include first and second end parts 90*a* and 90*b*, and an intermediate section 90*b* between the first and second end parts 90*a* and 90*b*. The first and second end parts 90*a* and 90*b* may be made of a soft material, and the intermediate section 90*b* may be made of a hard material. The first end part 90*a* and the second end part 90*b* may be made of a rubber material. The intermediate section 90*b* may be made of a material harder than the rubber material, for example, polypropylene (PP).

Since the intermediate section 90*b* is hard, when the pump 100 is operated, although water flows through the circulating hose 90', the intermediate section 90*b* is not easily modified but maintains a location thereof. Accordingly, a possibility of the intermediate section 90*b* making contact with an inner surface of the cabinet 1 and the outer tub 6 is reduced. Since the first end part 90*a* and the second end part 90*b* coupled with the pump 100 and the circulating nozzle 12, respectively are made of a flexible material, transfer of vibration of the pump 100 or vibration during a spray procedure through the circulating nozzle 12 to the intermediate section 90*b* is reduced.

An EPDM material hose part of the circulating hose 90 may have a pipe or hose thickness of 3 mm, an inner diameter of 18 mm, and an outer diameter of 24 mm. Further, a PP material hose part of the circulating hose 90 may have a pipe or hose thickness of 2.5 mm, an inner diameter of 20 mm, and an outer diameter of 25 mm. The circulating hose 90 may be attached to the outer tub 6. If the circulating hose 90 is firmly coupled with the outer tub 6, the circulating hose 90 may reduce danger which a coupling part between the outer tub 6 and the circulating hose 90 is damaged.

In the first embodiment, the upward extending part 91 may include a fixing part which may make contact with the outer tub 6 and extend upward, and fix the upward extending part 91 and the outer tub 6 to a specific location of the outer tub 6. Moreover, the pump connecting part 92 or the first curved part 93 may be attached to the outer tub 6. The upward extending part 91 may include a fixing part for fixing the pump connecting part 92 or the first curved part 93 to the outer tub 6. In addition, the nozzle connecting part 94, the second curved part 95, or the third curved part 97 may be attached to the outer tub 6. The upward extending part 91 may include a fixing part for fixing the pump connecting part 94, the second curved part 95, or the third curved part 97 to the outer tub 6.

In a second embodiment, the circulating hose 90 may be spaced apart from the outer tub 6. When the inner tub 5 is rotated, the outer tub 6 vibrates. Damage danger of the circulating hose 90 may be reduced and noise due to contact may be reduced by preventing a surface of the vibrated outer tub 6 from making contact with a surface of the circulating hose 90.

In the second embodiment, the washing machine may include a fixing part 71 which is spaced upward apart from a top side of the base 9 in an inner surface of the rear surface 1*d*. The first fixing part 71 may fix the upward extending part 91 to the rear surface 1*d* and the lateral sides 1*b* and 1*c*. The washing machine may include a second fixing part 72 which is spaced upward from the first fixing part 71 by 260 mm in an inner surface of the rear surface 1*d*. The second fixing part 72 may fix the upward extending part 91 to the rear surface 1*d* and lateral sides 1*b* and 1*c*. Accordingly, the upward extending part 91 may be fixed to the cabinet 1 by uniformly decomposing a load of the upward extending part 91. In the present description, the 280 mm and the 260 mm include an error range allowed in those skilled in the art.

In the second embodiment, the washing machine may include a third fixing part 73 which is provided at an inner surface of the top cover 2*a* to fix the circulating hose 90 to the top cover 2*a* in a downstream side of the third curved part 97. Accordingly, a top side supports a weight of the circulating hose 90, and the circulating hose 90 is spaced apart from a top surface of the outer tub 6.

According to embodiments disclosed herein, a washing machine may change a spray angle of the circulating nozzle to efficiently soak fabrics exposed in air of the inner tub. A washing deviation according to a clothes amount may be reduced by changing the spray angle of the circulating nozzle according to the clothes amount during washing. Fabrics or laundry may be uniformly soaked while saving an amount of water used for washing. In addition, since water may be supplied to fabrics exposed in air using a circulating nozzle, discoloration occurring when the fabrics are exposed in air or secondary pollution due to coagulation of detergent grounds can be prevented.

Figure 26:
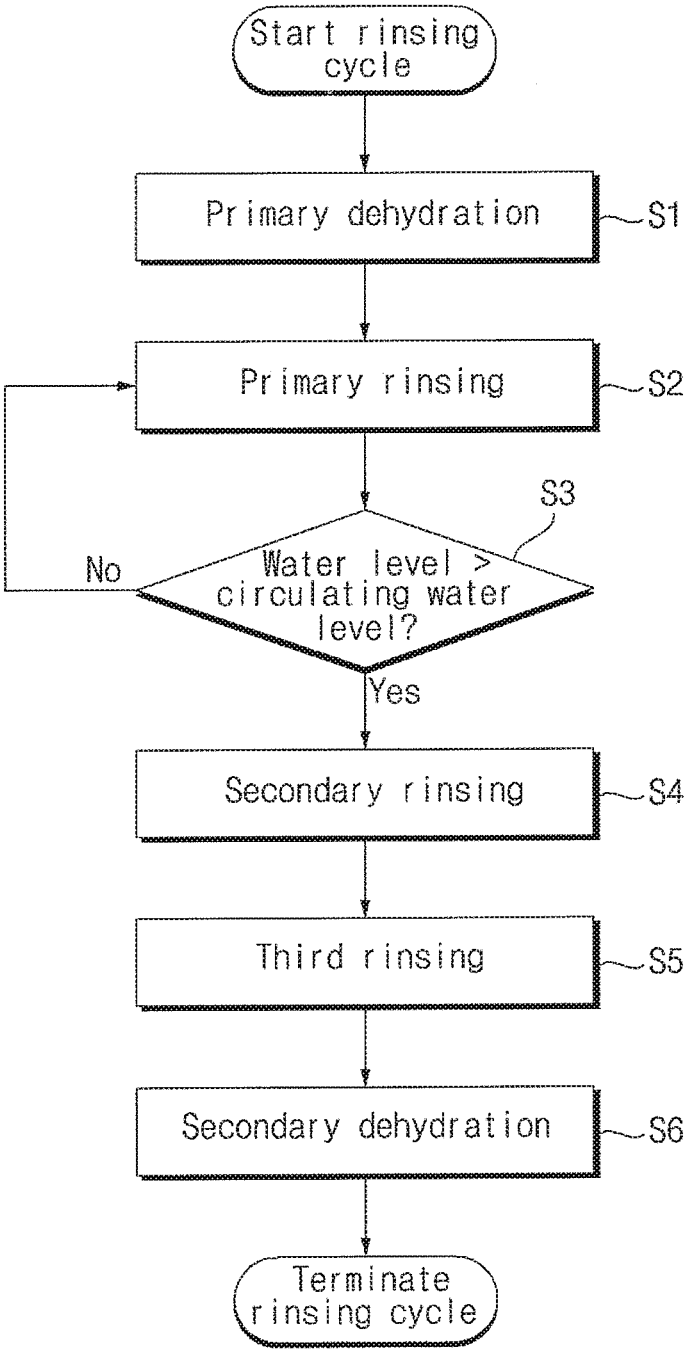
FIG. 26 is a flowchart illustrating a method for controlling a rinsing cycle of a washing machine according to an embodiment.
Figure 27A:
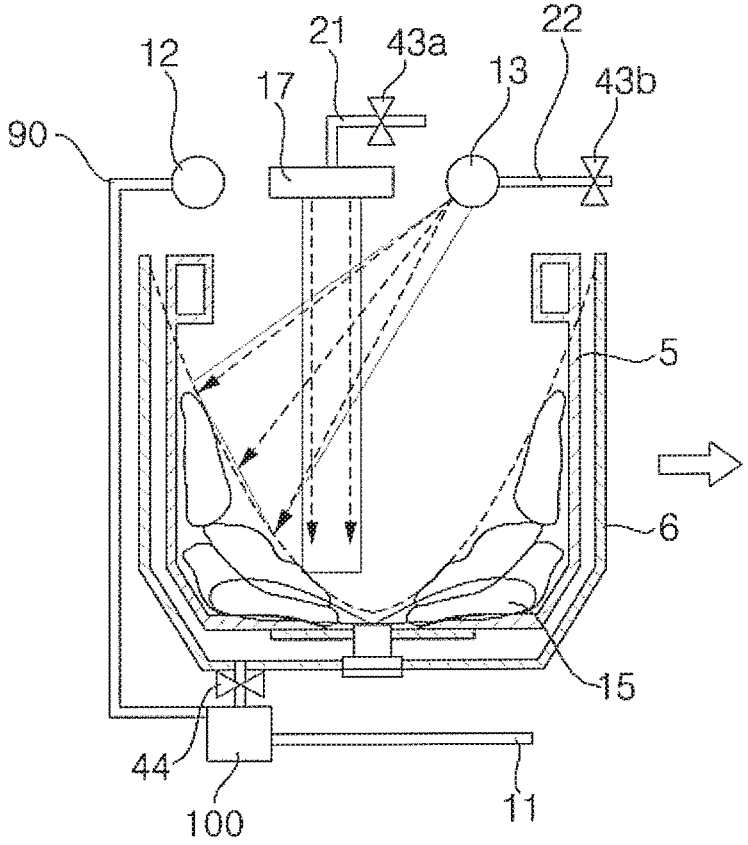
FIG. 27A is a schematic view illustrating a water supply scheme in a primary rinsing step.
Figure 27B:
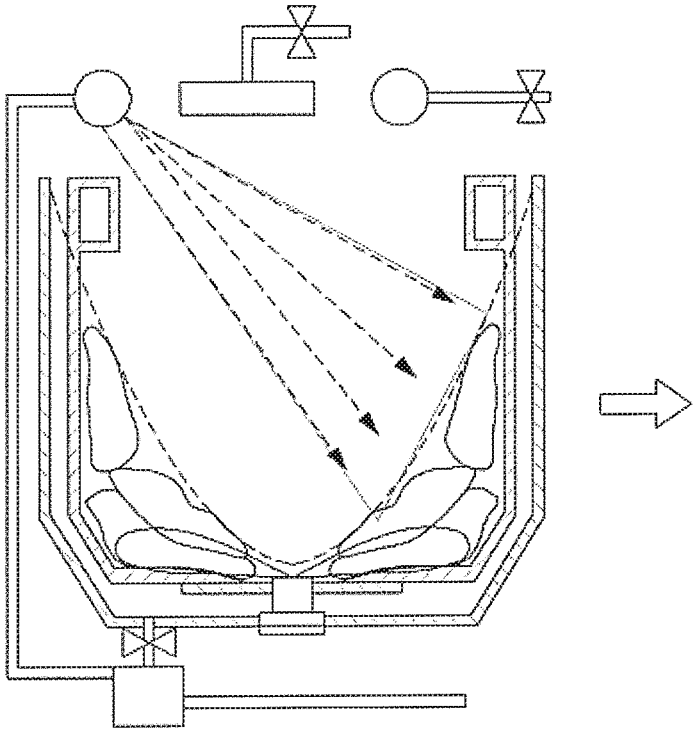
FIG. 27B is a schematic view illustrating spray through a circulating nozzle in a secondary rinsing step.
Figure 27C:
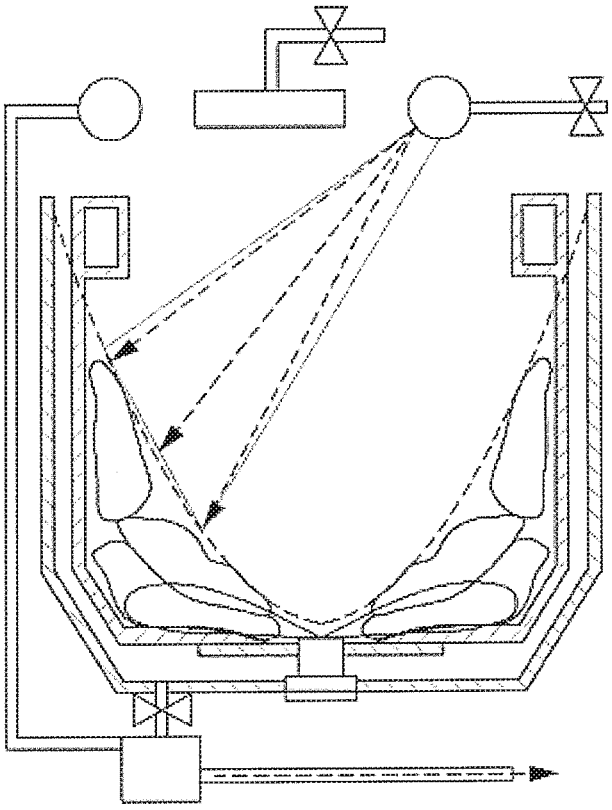
FIG. 27C is a schematic view illustrating a water supply scheme in a third rinsing step.
Figure 28:
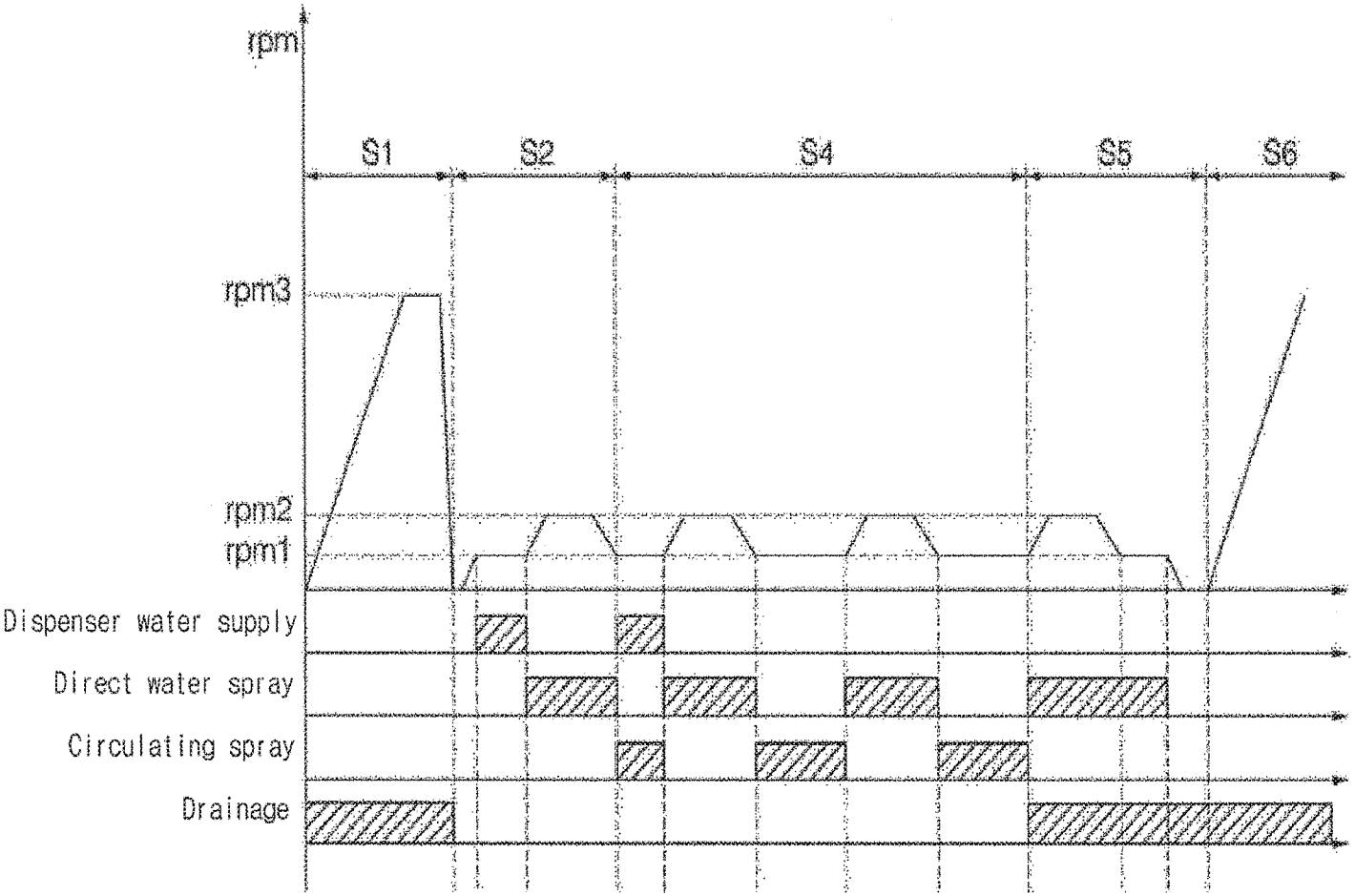
FIG. 28 illustrates an operation of respective parts of a washing machine while the washing machine is controlled by the control method shown in FIG. 26.

Referring to FIG. 26 to FIG. 28, a rinsing cycle in a washing machine according to an embodiment may include a primary dehydration step S1, a primary rinsing step S2, a water level determining step S3, a secondary rinsing step S4, a third rinsing step S5, and a secondary dehydration step S6. The primary dehydration step S1 may be performed after the washing cycle is terminated. An inner tub 5 is rotated at high speed (rpm3, about 450 rpm) so that fabrics may be dehydrated. While the inner tub 5 is rotated, pumps 100, 100*a*, and 100*b* are operated or rotated in a reverse direction, and are separated from fabrics so that water introduced into the pumps 100, 100*a*, and 100*b* through a drainage bellows 18 may be exhausted through a drainage hose 11.

In the primary rinsing step S2, the water may be supplied into the inner tub 5 until a water level in an outer tub 6 becomes a preset circulating water level Wset. In this case, some of the clothes amount corresponding to the preset circulating water level Wset may be supplied through a drawer 172, and a remaining amount may be sprayed through a direct water nozzle 13. For example, in the primary rinsing step S2, when the water is supplied through the drawer 172, a third water supply valve 43*a* may be opened. In this case, the water is supplied to a fiber softener receiving portion 172*b* through a third water supply hose 21. However, the present disclosure is not limited thereto. The water may be supplied through a detergent receiving portion 172*a*. In this case, a first water supply valve and/or a second water supply valve for blocking the water to be supplied to each port may be opened so that the water is supplied through a first water supply port 171*a* and/or a second water supply port 171*b*.

In the primary rinsing step S2, after the inner tub 5 is rotated at first rotating speed rpm1, acceleration is achieved from the first rotating speed rpm1 to a second rotating speed rpm2. The first rotating speed rpm1 may be about 30 rpm and the second rotating speed rpm2 may be 220 rpm.

Water supply or "dispenser water supply" through the drawer 172 may be achieved while the inner tub 5 is rotated at the first rotating speed rpm1. Locations of the fabrics in the inner tub 5 may be moved at the first rotating speed rpm1. Accordingly, fabrics stuck to an inner surface of the inner tub 5 due to the dehydration S1 may be uniformly into the inner tub 5, and a fiber softener supplied simultaneously with the water supply may penetrate into the fabrics.

Water supply or "direct water spray" through the direct water nozzle 13 may be achieved while the inner tub 5 is rotated at the second rotating speed rpm2. Fabrics are rotated integrally with the inner tub 5 while being stuck to an inner surface of the inner tub 5 due to a centrifugal force occurring by rotation of the inner tub 5. Accordingly, the water sprayed through the direct water nozzle 13 may uniformly reach the fabrics.

In the primary rinsing step S2, the water supply through the direct water nozzle 13 may be performed at a period when the inner tub 5 is accelerated from the first rotating speed rpm1 to the second rotating speed rpm2 and a period when the inner tub 5 is reduced from the second rotating speed rpm2 to the first rotating speed rpm1.

According to an embodiment, in the primary rinsing step S2, the water supply through the drawer 172 and the water supply through the direct water may be simultaneously performed, which are illustrated in FIG. 7A.

If the water level W sensed by the water level sensor 42 becomes a circulating water level Wset in step S3, the controller 30 may control to stop the water supply through a dispenser 17. For example, the controller 30 may block a third water supply valve 43*a* (S3). It is preferable that the circulating water level Wset is set within a range to continuously circulate the water through the circulating hose 90 while the pumps 100, 100*a*, and 100*b* are operated at preset speed. The circulating water level Wset may be set corresponding to a water amount of about 10 L.

In the secondary rinsing step S4, spray ("circulating spray") through the circulating nozzle 12 may be performed (see FIG. 27B). In this case, the inner tub 5 may be rotated at the first rotating speed rpm1. The secondary rinsing step S4 may include a step of supplying water through the drawer 172. A third water supply valve 53*a* may be open for a predetermined time. Although most fiber softener is supplied into the inner tub 5 together with the water in the primary rinsing step S2, a fiber softener remaining in the drawer 172 may be exhausted together with the water by again supplying the water into the fiber softener receiving portion 172*b*. It is preferable that the water supply through the drawer 172 is performed at least once before the water is sprayed into the inner tub 5 through the direct water nozzle 13.

In the secondary rinsing step S4, the water may be sprayed through the circulating nozzle while the water supply is performed through the drawer 172. In this case, the inner tub 5 may be rotated at the first rotating speed rpm1. The water spray through the direct water nozzle 13 is following to the water spray through the circulating nozzle 12. While the water is sprayed through the direct water nozzle 13, the inner tub 5 may be rotated at the second rotating speed rpm2. The water spray through the circulating nozzle 12 and the water spray through the direct water nozzle 13 may be alternatively performed preset times.

In the secondary rinsing step S4, the direct water nozzle 13 may be performed at one of a period when the inner tub 5 is accelerated to the second rotating speed rpm2 and a period when the inner tub 5 rotated at the second rotating speed rpm2 is reduced to the first rotating speed rpm1. In the third rinsing step S5, while the drainage of the outer tub 6 is performed, the water may be sprayed through the direct water nozzle 13. In this case, the inner tub 5 may be rotated at the second rotating speed rpm2. After the inner tub 5 rotated at the second rotating speed rpm2 is reduced to the first rotating speed rpm1, the inner tub 5 may be rotated to maintain the first rotating speed rpm1 for a predetermined time. In this procedure, the water may be sprayed through a direct water nozzle 13.

While the secondary rinsing step S4 is performed, drainage may be performed. In the secondary rinsing step S4, the water sprayed through the direct water nozzle 13 penetrates fabrics and is exhausted from the inner tub 5 to the outer tub 6. The water exhausted from the outer tub 6 may be exhausted into a drainage hose 11 by pumps 100, 100*a*, and 100*b*. In the secondary dehydration step S6, the inner tub 5 may be rotated at a third rotating speed rpm3 higher than the second rotating speed rpm2. While the inner tub 5 is rotated, the drainage may be performed.

Figure 29:
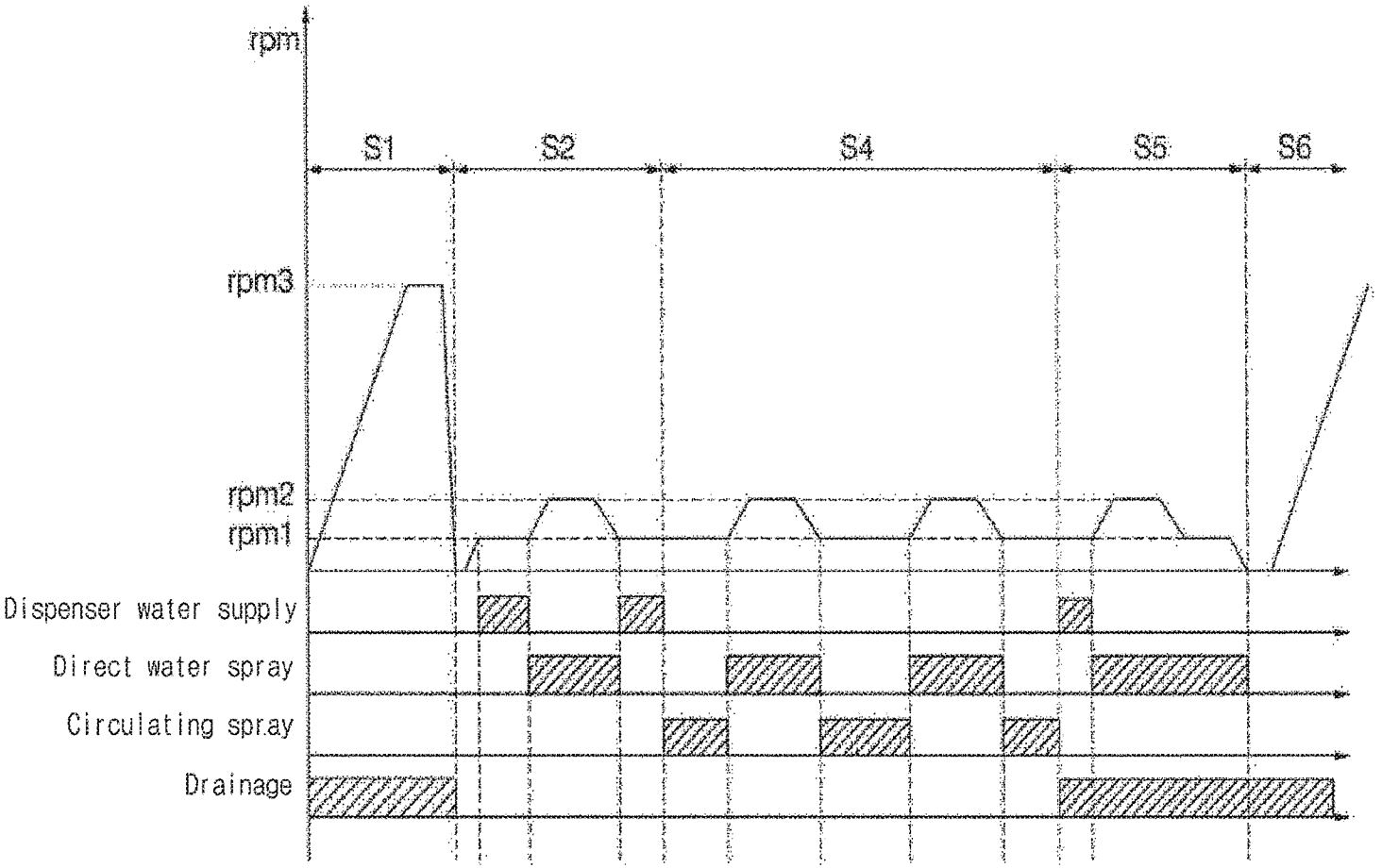
FIG. 29 illustrates an operation of respective parts of a washing machine in a rinsing cycle of the washing machine according to another embodiment.

FIG. 29 illustrates an operation of respective parts of a washing machine in a rinsing cycle of the washing machine according to another embodiment. Hereinafter, a same configuration as that of the above embodiments among respective steps shown in FIG. 29 depends on the above description with reference to FIG. 28. The following description may be made while focusing on a part different from the above embodiments. Referring to FIG. 29, in a method for controlling a rinsing cycle of a washing machine according to another embodiment of the present disclosure, in a primary rinsing step S2, after spray is performed through the direct water nozzle 13, the water may be supplied through a drawer 172.

In a third rinsing step S5, before the spray is performed through the direct water nozzle 13, the water may be supplied through a drawer 172. For example, water supply trough the drawer 172 may be performed through a fiber softener receiving portion 172*b*. The fiber softener receiving portion 172*b* may be cleaned up by finally supplying the water once again.

According to embodiments disclosed herein, a method for controlling a rinsing cycle of a washing machine can improve a rinsing performance while reducing a used amount of water. Laundry or fabrics in an inner tub can be uniformly rinsed. Water in an outer tub is circulated by spraying the water through a circulating nozzle. During this procedure, a fiber softener may be uniformly in the water. Accordingly, the fiber softener may actively penetrate fabrics Embodiments disclosed herein provides a washing machine including a direct water nozzle and a circulating nozzle and a method for controlling a rinsing cycle applied to the washing machine. The washing machine may be capable of improving a rinsing performance while reducing a used amount of water and a method for controlling a rinsing cycle of the washing machine. The washing machine may be capable of uniformly rinsing fabric or fabrics in an inner tub and a method for controlling a rinsing cycle of the washing machine.

According to embodiments disclosed herein, a method for controlling a rinsing cycle of a washing machine including an outer tub for receiving water, an inner tub rotated based on a vertical axis in the outer tub, a circulating nozzle for spraying the water exhausted from the outer tub and supplied through a circulating hose into the inner tub, and a direct water nozzle for spraying water supplied from an external water source into the inner tub, the method may include: a primary rinsing step of supplying water into the inner tub until a water level in the outer tub becomes a preset circulating water level wherein some of a water amount corresponding to the circulating water is supplied through a drawer for receiving a fiber softener, and remaining water amount is supplied by spraying the water supplied from the external water source through a direct water supply hose through a direct water nozzle; a secondary rinsing step of spraying water into the inner tub through the circulating nozzle; and a third rinsing step of spraying the water into the inner tub through the direct water nozzle while draining the outer tub.

According to embodiments disclosed herein, a method for controlling a rinsing cycle of a washing machine including an outer tub, an inner tub rotated on a vertical axis in the outer tub, a circulating nozzle that sprays the water discharged from the outer tub and supplied through a circulating hose into the inner tub, and a direct water nozzle that sprays water supplied from an external water source into the inner tub, the method may include a primary rinsing by supplying water into the inner tub until a water level in the outer tub becomes a preset circulating water level, wherein some of the water is supplied through a drawer in the washing machine that holds fabric softener, and a remaining amount of water is supplied by spraying the water supplied from the external water source through the direct water nozzle via a direct water supply hose, a secondary rinsing by spraying water into the inner tub through the circulating nozzle, and a third rinsing by spraying the water into the inner tub through the direct water nozzle while draining the outer tub.

This application relates to U.S. application Ser. No. 15/283,488; Ser. No. 15/283,527; Ser. No. 15/283,571, Ser. No. 15/283,601, and Ser. No. 15/283,662, all filed on Oct. 3, 2016, which are hereby incorporated by reference in their entirety. Further, one of ordinary skill in the art will recognize that features disclosed in these above-noted applications may be combined in any combination with features disclosed herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a rinsing cycle of a washing machine including an outer tub, an inner tub rotated on a vertical axis in the outer tub, a circulating nozzle that sprays the water discharged from the outer tub and supplied through a circulating hose into the inner tub, and a direct water nozzle that sprays water supplied from an external water source into the inner tub, the method comprising:

a primary rinsing by supplying water into the inner tub until a water level in the outer tub becomes a preset circulating water level, wherein some of the water is supplied through a drawer in the washing machine that holds fabric softener, and a remaining amount of water is supplied by spraying the water supplied from the external water source through the direct water nozzle via a direct water supply hose;

a secondary rinsing by spraying water into the inner tub through the circulating nozzle; and a third rinsing by spraying the water into the inner tub through the direct water nozzle while draining the outer tub, wherein, during the primary rinsing, the water is sprayed through the direct water nozzle after supplying the water through the drawer, wherein the primary rinsing includes:

rotating the inner tub at a first rotation speed;

accelerating a rotation speed of the inner tub from the first rotation speed to a second rotation speed such that the laundry attaches to an inner surface of the inner tub; and reducing the inner tub to the first rotation speed after operating the inner tub at the second rotation speed for a preset time, wherein the water is supplied through the drawer while the miner tub is rotated at the first rotation speed, and the water is sprayed through the direct water nozzle when the inner tub is rotated at the second rotation speed.

2. The method of claim 1, wherein the washing machine further includes a pump to pump water discharged from the outer tub into the circulating hose, and the preset circulating water level is set within a range to continuously circulate the water through the circulating hose while the pump is operated at a preset speed.

3. The method of claim 1, wherein the primary rinsing further includes spraying water through the direct water nozzle during at least one of a first time period when the inner tub is accelerated to the second rotation speed and a second time period when the inner tub is reduced from the second rotation speed to the first rotation speed.

4. The method of claim 1, wherein the secondary rinsing further includes supplying water through the drawer before spraying the water into the inner tub through the circulating nozzle.

5. The method of claim 4, wherein the secondary rinsing includes spraying the water through the circulating nozzle while supplying the water through the drawer.

6. A method for controlling a rinsing cycle of a washing machine including an outer tub, an inner tub rotated on a vertical axis in the outer tub, a circulating nozzle that sprays the water discharged from the outer tub and supplied through a circulating hose into the inner tub, and a direct water nozzle that sprays water supplied from an external water source into the inner tub, the method comprising:

a primary rinsing by supplying water into the inner tub until a water level in the outer tub becomes a preset circulating water level, wherein some of the water us supplied through a drawer in the washing machine that holds fabric softener, and a remaining amount of water is supplied by spraying the water supplied from the external water source through the direct water nozzle via a direct water supply hose;

a secondary rinsing by spraying water into the inner tub through the circulating nozzle and through the direct water nozzle; and a third rinsing by spraying the water into the inner tub through the direct water nozzle while draining the outer tub, wherein the secondary rinsing further includes repeatedly spraying the water through the circulating nozzle and spraying the water through the direct water nozzle for preset times, wherein the secondary rinsing further includes:

rotating the inner tub at a first rotation speed;

accelerating a rotation speed of the inner tub from the first rotation speed to a second rotation speed such that the laundry attaches to an inner surface of the inner tub; and reducing the inner tub to the first rotation speed after operating the inner tub at the second rotation speed for a preset time, wherein spraying the water through the circulating nozzle is performed while the inner tub is rotated at the first rotation speed, and spraying the water through the direct water nozzle is performed while the inner tub is rotated at the second rotation speed.

7. The method of claim 6, wherein the secondary rinsing further includes spraying water through the direct water nozzle during at least one of a first time period when the inner tub is accelerated to the second rotation speed and a second time period when the inner tub is reduced from the second rotation speed to the first rotation speed.

8. The method of claim 1, wherein the third rinsing further includes rotating the inner tub at a rotation speed such that the laundry is forced towards an inner surface of the inner tub, and the water is sprayed through the direct water nozzle while the inner tub is rotated at the rotation speed.

9. The method of claim 1, further comprising dehydrating the laundry by rotating the outer tub with the inner tub such that the laundry attaches to an inner surface of the inner tub while draining the outer tub, wherein the primary rinsing is performed after the dehydrating.

10. The method of claim 9, wherein after the third rinsing, the dehydrating is further performed.

11. The method of claim 1, wherein the primary rinsing further includes supplying the water through the drawer after performing spraying the water through the direct water nozzle.

12. The method of claim 11, wherein the third rinsing further includes supplying the water through the drawer before spraying the water through the direct water nozzle.

* * * * *